US008041072B2

(12) United States Patent
Kondo et al.

(10) Patent No.: US 8,041,072 B2
(45) Date of Patent: Oct. 18, 2011

(54) AUDIO OUTPUT APPARATUS AND METHOD

(75) Inventors: Tetsujiro Kondo, Tokyo (JP); Junichi Shima, Kanagawa (JP); Akihiko Arimitsu, Kanagawa (JP)

(73) Assignee: Sony Corporation, Tokyo (JP)

( * ) Notice: Subject to any disclaimer, the term of this patent is extended or adjusted under 35 U.S.C. 154(b) by 1355 days.

(21) Appl. No.: 11/581,445

(22) Filed: Oct. 17, 2006

(65) Prior Publication Data

US 2007/0092092 A1 Apr. 26, 2007

(30) Foreign Application Priority Data

Oct. 20, 2005 (JP) ..... P2005-305566

(51) Int. Cl.
*H04R 1/00* (2006.01)
*H04R 25/00* (2006.01)

(52) U.S. Cl. ..... 381/431; 381/152

(58) Field of Classification Search ..... 381/152, 381/423, 424, 431; 181/163, 164
See application file for complete search history.

(56) References Cited

U.S. PATENT DOCUMENTS

| | | | | |
|---|---|---|---|---|
| 6,427,016 | B1 | 7/2002 | Azima et al. | |
| 6,813,362 | B2 * | 11/2004 | Bank et al. | 381/152 |
| 6,904,154 | B2 * | 6/2005 | Azima et al. | 381/152 |
| 7,062,064 | B2 * | 6/2006 | Bachmann et al. | 381/152 |
| 7,095,863 | B2 * | 8/2006 | Heron et al. | 381/152 |

FOREIGN PATENT DOCUMENTS

| | | | |
|---|---|---|---|
| JP | 58-48186 | U | 3/1983 |
| JP | 58-54718 | | 12/1983 |
| JP | 1-135291 | | 5/1989 |
| JP | 2-122796 | A | 5/1990 |
| JP | 11-220785 | | 8/1999 |
| JP | 11-220786 | A | 8/1999 |
| JP | 11-512254 | | 10/1999 |
| JP | 2000-358290 | A | 12/2000 |
| JP | 2001-136594 | A | 5/2001 |
| JP | 2001-148893 | A | 5/2001 |
| JP | 2001-217633 | A | 8/2001 |
| JP | 2002-505814 | | 2/2002 |
| JP | 2002-532038 | | 9/2002 |
| JP | 2002-532993 | A | 10/2002 |
| JP | 2003-125475 | A | 4/2003 |
| JP | 2003-522426 | | 7/2003 |
| JP | 2005-79962 | A | 3/2005 |
| JP | 2005-269423 | A | 9/2005 |
| WO | WO 97/09862 | | 3/1997 |
| WO | WO 98/52381 | | 11/1998 |
| WO | WO 00/33612 | | 6/2000 |

OTHER PUBLICATIONS

Office Action issued Sep. 16, 2010, in Japan Patent Application No. 2005-305566 (with English-language Translation). Tamon Saeki, New Version of Speaker and Enclosure, Japan, Seibundo Corporation Co., Ltd., Aug. 1, 2002, third print, pp. 100-102.

* cited by examiner

*Primary Examiner* — Brian Ensey
(74) *Attorney, Agent, or Firm* — Oblon, Spivak, McClelland, Maier & Neustadt, L.L.P.

(57) ABSTRACT

An audio output apparatus for converting an input audio signal into audio and outputting the audio includes a first oscillation enhancing panel for outputting the audio as a result of being oscillated; a second oscillation enhancing panel for outputting the audio as a result of being oscillated; a first transducer for allowing the first oscillation enhancing panel to oscillate on the basis of an audio signal, the first transducer being disposed in the first oscillation enhancing panel; and a second transducer for allowing the second oscillation enhancing panel to oscillate on the basis of an audio signal, the second transducer being disposed at a position on the second oscillation enhancing panel, the position on the second oscillation enhancing panel differing from the position corresponding to the position of the first transducer in the first oscillation enhancing panel.

13 Claims, 19 Drawing Sheets

THREE FREQUENCY CHARACTERISTICS

AUDIO OUTPUT APPARATUS AND METHOD

CROSS REFERENCES TO RELATED APPLICATIONS

The present invention contains subject matter related to Japanese Patent Application JP 2005-305566 filed in the Japanese Patent Office on Oct. 20, 2005, the entire contents of which are incorporated herein by reference.

BACKGROUND OF THE INVENTION

1. Field of the Invention

The present invention relates to an audio output apparatus and method and, more particularly, relates to an audio output apparatus and method capable of accurately reproducing input audio.

2. Description of the Related Art

Audio output apparatuses for outputting audio by allowing a plate-shaped flat panel (oscillation enhancing panel) to oscillate by means of a transducer are widely known. Such audio output apparatuses can project sound over a wider area than cone-shaped audio output apparatuses and thus have advantages that the sweet spot (optimum listening area) thereof is wide.

In order to more accurately reproduce input audio, there has been a demand for an audio output apparatus to have frequency characteristics as flat as possible. That is, when an audio signal of audio whose sound volume (audio level) has the same constant value for every frequency is input to an audio output apparatus and is reproduced, the closer to a constant state the sound volume (audio level) for every frequency of audio reproduced by the audio output apparatus, the more accurately the audio output apparatus can reproduce the input audio.

In an audio output apparatus of the related art, in order to realize frequency characteristics as flat as possible, the position of a transducer in an oscillation enhancing panel is changed on the basis of results of the analysis of parameters of the power transmission of the oscillation enhancing panel (refer to, for example, PCT Japanese Translation Patent Publication No. 2003-522426).

Furthermore, there is a known apparatus in which, in order to reduce feature points that occur at a coincidence frequency, two transducers arranged in an oscillation enhancing panel are separated by a distance of a half wavelength of the coincidence frequency of the oscillation enhancing panel (refer to, for example, PCT Japanese Translation Patent Publication No. 2002-532038). Also, there is a known apparatus in which a small oscillation enhancing panel and a large oscillation enhancing panel larger than the small oscillation enhancing panel are made to overlap each other, and audio of a wide frequency bandwidth is reproduced by driving these oscillation enhancing panels by using the same exciter (refer to, for example, PCT Japanese Translation Patent Publication No. 2002-505814).

SUMMARY OF THE INVENTION

However, the frequency characteristics of an audio output apparatus are dependent on the characteristics of an oscillation enhancing panel of the audio output apparatus and the position of a transducer arranged in the oscillation enhancing panel. Consequently, in the above-described related art, it is difficult to obtain flat frequency characteristics over the entire frequency bandwidth of the audio that is output by the audio output apparatus, and thus it is difficult to reproduce the input audio accurately.

That is, when an oscillation enhancing panel is made to oscillate, oscillations of a plurality of oscillation frequencies occur. Therefore, it is not possible to cause only the oscillations of a desired vibration frequency to occur by only changing the position of the transducer in the oscillation enhancing panel. Therefore, it is not possible to obtain flat frequency characteristics over the entire bandwidth of the frequency audio that is output by the audio output apparatus.

When the sound volume of a predetermined frequency bandwidth of audio that is output by the audio output apparatus is to be amplified or attenuated, by only changing the position of the transducer arranged in the oscillation enhancing panel, it is not possible to amplify or attenuate only the sound volume of a desired frequency bandwidth without influencing the frequency characteristics of frequency bandwidths in the vicinity of the predetermined frequency bandwidth.

The present invention has been made in view of such circumstances. More accurate reproduction of input audio and easier adjustment of the sound volume of a desired frequency bandwidth are desirable.

According to an embodiment of the present invention, there is provided an audio output apparatus for converting an input audio signal into audio and outputting the audio, the audio output apparatus including: a first oscillation enhancing panel for outputting the audio as a result of being oscillated; a second oscillation enhancing panel for outputting the audio as a result of being oscillated; a first transducer for allowing the first oscillation enhancing panel to oscillate on the basis of an audio signal, the first transducer being attached in the first oscillation enhancing panel; and a second transducer for allowing the second oscillation enhancing panel to oscillate on the basis of an audio signal, the second transducer being attached at a position on the second oscillation enhancing panel, the position on the second transducer differing from the position corresponding to the position of the first transducer in the first oscillation enhancing panel.

The audio output apparatus may further include a filtering unit for allowing components of a predetermined frequency bandwidth among the components of the audio signal input to the first transducer or the second transducer to pass.

The audio output apparatus may further include a gain adjustment unit for adjusting the gain of the audio signal input to the first transducer or the second transducer.

In the audio output apparatus, the size of the first oscillation enhancing panel may be the same as the size of the second oscillation enhancing panel, and the position of the second transducer, in which the center of the second oscillation enhancing panel is used as a reference, may differ from the position of the first transducer, in which the center of the first oscillation enhancing panel is used as a reference.

In the audio output apparatus, at least one of the thickness, size, material, and fixation method of the first oscillation enhancing panel may differ from the thickness, size, material, and fixation method of the second oscillation enhancing panel.

According to another embodiment of the present invention, there is provided an audio output method for converting an input audio signal into audio and outputting the audio, the audio output method including the steps of: attaching a first transducer for allowing a first oscillation enhancing panel to oscillate on the basis of an audio signal in the first oscillation enhancing panel that outputs the audio as a result of being oscillated; attaching a second transducer for allowing a second oscillation enhancing panel to oscillate on the basis of an audio signal in the second oscillation enhancing panel for outputting the audio as a result of being oscillated, the second transducer being attached at a position on the second oscillation enhancing panel, the position on the second transducer differing from the position corresponding to the position of the first transducer in the first oscillation enhancing panel; and inputting an audio signal to the first transducer and the second transducer and outputting audio by allowing the first oscillation enhancing panel and the second oscillation enhancing panel to oscillate so that the oscillation excitation position of the second oscillation enhancing panel becomes different from the position corresponding to the oscillation excitation position of the first oscillation enhancing panel.

In the audio output apparatus and the audio output method according to an embodiment of the present invention, a first transducer for allowing a first oscillation enhancing panel to oscillate on the basis of an audio signal is attached in the first oscillation enhancing panel that outputs the audio as a result of being oscillated. A second transducer for allowing a second oscillation enhancing panel to oscillate on the basis of an audio signal is attached in the second oscillation enhancing panel for outputting the audio as a result of being oscillated, the second transducer being attached at a position on the second oscillation enhancing panel, the position on the second transducer differing from the position corresponding to the position of the first transducer in the first oscillation enhancing panel. An audio signal is input to the first transducer and the second transducer, and audio is output by allowing the first oscillation enhancing panel and the second oscillation enhancing panel to oscillate so that the oscillation excitation position of the second oscillation enhancing panel becomes different from the position corresponding to the oscillation excitation position of the first oscillation enhancing panel.

According to another embodiment of the present invention, there is provided an audio output apparatus for converting an input audio signal into audio and outputting the audio, the audio output apparatus including: a first oscillation enhancing panel for outputting the audio as a result of being oscillated; a second oscillation enhancing panel for outputting the audio as a result of being oscillated; a first transducer for allowing the first oscillation enhancing panel to oscillate on the basis of an audio signal, the first transducer being attached in the first oscillation enhancing panel; and a second transducer for allowing the second oscillation enhancing panel to oscillate on the basis of an audio signal, the second transducer being attached at a position on the second oscillation enhancing panel, the position on the second transducer corresponding to the position of the first transducer in the first oscillation enhancing panel, wherein at least one of the thickness, size, material, and fixation method of the first oscillation enhancing panel differs from the thickness, size, material, and fixation method of the second oscillation enhancing panel.

In the audio output apparatus according to another embodiment of the present invention, a first transducer for allowing a first oscillation enhancing panel to oscillate on the basis of an audio signal is attached in the first oscillation enhancing panel that outputs the audio as a result of being oscillated. A second transducer for allowing a second oscillation enhancing panel to oscillate on the basis of an audio signal is attached in the second oscillation enhancing panel for outputting the audio as a result of being oscillated, the second transducer being attached at a position on the second oscillation enhancing panel, the position of the second transducer corresponding to the position of the first transducer in the first oscillation enhancing panel. At least one of the thickness, size, material, and fixation method of the first oscillation enhancing panel differs from the thickness, size, material, and fixation method of the second oscillation enhancing panel.

As described above, according to the embodiment of the present invention, audio can be reproduced. In particular, input audio can be reproduced more accurately. Furthermore, the sound volume of a desired frequency bandwidth can be adjusted more easily.

DESCRIPTION OF THE PREFERRED EMBODIMENTS

Figure 1:
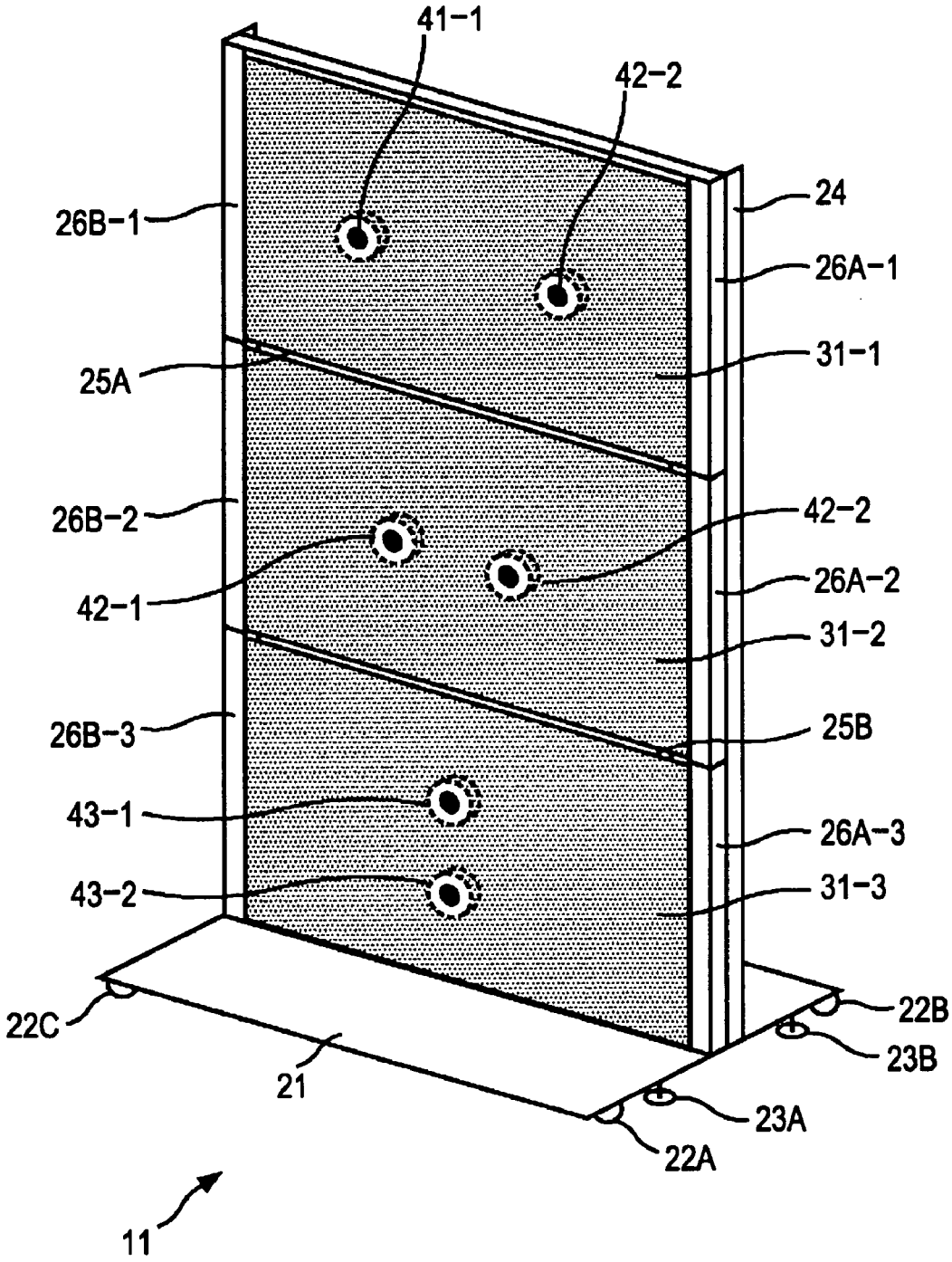
FIG. 1 shows the exterior of a screen speaker apparatus according to an embodiment of the present invention.

Before describing an embodiment of the present invention, the correspondence between the features of the claims and the specific elements disclosed in an embodiment of the present invention is discussed below. This description is intended to assure that embodiments supporting the claimed invention are described in this specification. Thus, even if an element in the following embodiments is not described as relating to a certain feature of the present invention, that does not necessarily mean that the element does not relate to that feature of the claims. Conversely, even if an element is described herein as relating to a certain feature of the claims, that does not necessarily mean that the element does not relate to other features of the claims.

An audio output apparatus according to an embodiment of the present invention includes: a first oscillation enhancing panel (for example, an oscillation enhancing panel 31-1 of FIG. 1) for outputting audio as a result of being oscillated; a second oscillation enhancing panel (for example, an oscillation enhancing panel 31-2 of FIG. 1) for outputting audio as a result of being oscillated; a first transducer (for example, a transducer 41-1 and a transducer 41-2 of FIG. 1) for allowing the first oscillation enhancing panel to oscillate on the basis of an audio signal, the first transducer being attached in the first oscillation enhancing panel; and a second transducer (for example, a transducer 42-1 and a transducer 42-2 of FIG. 1) for allowing the second oscillation enhancing panel to oscillate on the basis of an audio signal, the second transducer being disposed at a position on the second oscillation enhancing panel, the position on the second transducer differing from the position corresponding to the position of the first transducer in the first oscillation enhancing panel.

The audio output apparatus may further include a filtering unit (for example, a filter processor 122 of FIG. 12) for allowing components of a predetermined frequency bandwidth among the components of the audio signal input to the first transducer or the second transducer to pass.

The audio output apparatus may further include a gain adjustment unit (for example, a gain adjuster 123 of FIG. 12) for adjusting the gain of the audio signal input to the first transducer or the second transducer.

An audio output method according to an embodiment of the present invention includes the steps of: attaching a first transducer (for example, a transducer 41-1 and a transducer 41-2 of FIG. 1) for allowing a first oscillation enhancing panel (for example, an oscillation enhancing panel 31-1 of FIG. 1) to oscillate on the basis of an audio signal in the first oscillation enhancing panel that outputs the audio as a result of being oscillated; attaching a second transducer (for example, a transducer 42-1 and a transducer 42-2 of FIG. 1) for allowing a second oscillation enhancing panel (for example, an oscillation enhancing panel 31-2 of FIG. 1) to oscillate on the basis of an audio signal in the second oscillation enhancing panel for outputting the audio as a result of being oscillated, the second transducer being attached at a position on the second oscillation enhancing panel, the position on the second transducer differing from the position corresponding to the position of the first transducer in the first oscillation enhancing panel; and inputting an audio signal to the first transducer and the second transducer and outputting audio (for example, step S14 and step S15 of FIG. 19) by allowing the first oscillation enhancing panel and the second oscillation enhancing panel to oscillate so that the oscillation excitation position of the second oscillation enhancing panel becomes different from the position corresponding to the oscillation excitation position of the first oscillation enhancing panel.

An audio output apparatus according to another embodiment of the present invention includes: a first oscillation enhancing panel (for example, an oscillation enhancing panel 201-1 of FIG. 20) for outputting the audio as a result of being oscillated; a second oscillation enhancing panel (for example, an oscillation enhancing panel 201-2 of FIG. 20) for outputting the audio as a result of being oscillated; a first transducer (for example, a transducer 202-1 and a transducer 202-2 of FIG. 20) for allowing the first oscillation enhancing panel to oscillate on the basis of an audio signal, the first transducer being attached in the first oscillation enhancing panel; and a second transducer (for example, a transducer 203-1 and a transducer 203-2 of FIG. 20) for allowing the second oscillation enhancing panel to oscillate on the basis of an audio signal, the second transducer being attached at a position on the second oscillation enhancing panel, the position on the second transducer corresponding to the position of the first transducer in the first oscillation enhancing panel, wherein at least one of the thickness, size, material, and fixation method of the first oscillation enhancing panel differs from the thickness, size, material, and fixation method of the second oscillation enhancing panel.

Embodiments to which the present invention is applied will be described below with reference to the drawings.

FIG. 1 shows the exterior of a screen (a free-standing, single-panel screen) speaker apparatus 11 of an embodiment of the present invention. The screen speaker apparatus 11 is an example of an audio output apparatus according to an embodiment of the present invention, which function as a speaker as well as a screen.

The screen speaker apparatus 11 includes a base 21, wheels 22A to 22D, apparatus supports 23A to 23D, a frame 24, load-bearing oscillation enhancing panel supports 25A and 25B, back-and-forth oscillation enhancing panel supports 26A-1 to 26B-3, an oscillation enhancing panels 31-1 to 31-3, and transducers 42-1, 42-2, 43-1, and 43-2.

The base 21 is made of, for example, a material with sufficient strength to support the frame 24, such as iron, aluminum, magnesium, or titanium. In the lower portion of the base 21 in FIG. 1, the wheels 22A to 22D (the wheel 22D is not shown) are provided at the four corners. Furthermore, in the vicinity thereof, the apparatus supports 23A to 23D (the apparatus supports 23C and 23D are not shown) are provided. For example, when the screen speaker apparatus 11 set in a room is pushed by a user, each of the wheels 22A to 22D rotates, causing the screen speaker apparatus 11 to move in the pushing direction. Furthermore, each of the apparatus supports 23A to 23D contacts the floor surface, thereby supporting the screen speaker apparatus 11.

That is, it is possible for the user to move and place the screen speaker apparatus 11 at a desired position.

Above the base 21, for example, the frame 24 is fixed by welding, and the frame 24 is arranged to stand upright on the base 21.

Although details will be described later, the frame 24 fixes the load-bearing oscillation enhancing panel supports 25A and 25B for fixing the oscillation enhancing panels 31-1 to 31-3 in a direction in which a weight is applied (in the downward direction in FIG. 1), and the back-and-forth oscillation enhancing panel supports 26A-1 to 26B-3 for fixing the oscillation enhancing panels 31-1 to 31-3 in a back-and-forth direction in FIG. 1. The oscillation enhancing panels 31-1 to 31-3 are removably fixed by these supports.

That is, the weight of the oscillation enhancing panel 31-1 is supported by the load-bearing oscillation enhancing panel support 25A, and the back-and-forth thereof is supported by the back-and-forth oscillation enhancing panel supports 26A-1 and 26B-1. Similarly to the oscillation enhancing panel 31-1, the weight of the oscillation enhancing panel 31-2 is supported by the load-bearing oscillation enhancing panel support 25B, and the back-and-forth thereof is supported by the back-and-forth oscillation enhancing panel supports 26A-2 and 26B-2. The oscillation enhancing panel 31-3 is supported by the upper portion of the frame 24, and the back-and-forth oscillation enhancing panel supports 26A-3 and 26B-3.

As described above, since each of the oscillation enhancing panels 31-1 to 31-3 is removably fixed in the vertical direction along the frame 24, the screen speaker apparatus 11 functions as a screen that has a predetermined height from the floor surface.

Furthermore, the oscillation enhancing panels 31-1 to 31-3 are arranged side by side in the vertical direction so that the oscillation enhancing panel 31-2 is positioned at the same height (the height in the vertical direction in FIG. 1) as the ears of a listener listening to audio output from the screen speaker apparatus 11.

The oscillation enhancing panels 31-1 to 31-3 are formed from plasterboard, wood such as an MDF (Medium-Density Fiberboard), an aluminum plate, carbon, a resin such as acryl, or a material such as glass so as to be plate-shaped. The oscillation enhancing panels 31-1 to 31-3 may also be formed from composite materials in which different materials are combined (laminated).

Furthermore, transducers 41-1 and 41-2 are mounted side by side in the horizontal direction in the oscillation enhancing panel 31-1 in FIG. 1. The transducers 42-1 and 42-2 are mounted side by side in the horizontal direction in the oscillation enhancing panel 31-2 in FIG. 1. In FIG. 1, the transducers are mounted in the oscillation enhancing panels 31-1 and 31-2 so that the distance from the transducer 42-1 to the transducer 42-2 is shorter than the distance from the transducer 41-1 to the transducer 41-2. Furthermore, the transducers 43-1 and 43-2 are mounted side by side in the vertical direction in the oscillation enhancing panel 31-3 in FIG. 1. The number of transducers mounted on each of the oscillation enhancing panels 31-1 to 31-3 may be one, three or more.

In the screen speaker apparatus 11, for example, since the transducers 41-1 and 41-2, 42-1 and 42-2, and 43-1 and 43-2 driven by a sound source (not shown), such as an amplifier, cause the oscillation enhancing panels 31-1 to 31-3 to oscillate, respectively, in response to an audio signal input from the sound source, each of the oscillation enhancing panels 31-1 to 31-3 outputs audio. That is, the screen speaker apparatus 11 functions as a speaker that converts the audio signal into sound.

Furthermore, the transducers 41-1 and 41-2, 42-1 and 42-2, and 43-1 and 43-2 are removably arranged at predetermined positions in accordance with the oscillation characteristics of the oscillation enhancing panels 31-1 to 31-3, respectively.

In the example of FIG. 1, in the screen speaker apparatus 11, three oscillation enhancing panels, that is, the oscillation enhancing panels 31-1 to 31-3, are fixed. However, in the embodiment of the present invention, the number of oscillation enhancing panels is not limited to three, and one or more oscillation enhancing panels can be removably fixed. That is, it is possible for the user to set the screen speaker apparatus 11 at a desired height by freely combining oscillation enhancing panels in the vertical direction.

In the example of FIG. 1, the oscillation enhancing panels 31-1 to 31-3 of the same size are arranged side by side in the vertical direction in FIG. 1. Alternatively, they may also be arranged side by side in the horizontal direction or in the oblique direction. However, it is preferable that the oscillation enhancing panels 31-1 to 31-3 be arranged side by side so that audio output from each of the oscillation enhancing panels 31-1 to 31-3 reaches the right and left ears of a listener at the same time.

Therefore, for example, when the listener stands in the vertical direction in FIG. 1 and listens to audio that is output at a position where the listener views the screen speaker apparatus 11 from the front side, it is preferable that the oscillation enhancing panels 31-1 to 31-3 be arranged side by side in the vertical direction, as shown in FIG. 1.

In the following description, when the load-bearing oscillation enhancing panel supports 25A and 25B need not be distinguished individually, they will be simply referred to as a load-bearing oscillation enhancing panel support 25. When the back-and-forth oscillation enhancing panel supports 26A-1 to 26B-3 need not be distinguished individually, they will be simply referred to as a back-and-forth oscillation enhancing panel support 26. When the back-and-forth oscillation enhancing panel supports 26A-1 to 26A-3 need not be distinguished individually, they will be simply referred to as a back-and-forth oscillation enhancing panel support 26A. When the back-and-forth oscillation enhancing panel supports 26B-1 to 26B-3 need not be distinguished individually, they will be simply referred to as a back-and-forth oscillation enhancing panel support 26B.

In the following, when the oscillation enhancing panels 31-1 to 31-3 need not be distinguished individually, they will be simply referred to as an oscillation enhancing panel 31. Furthermore, in the following, when the transducers 41-1 and 41-2 need not be distinguished individually, they will be simply referred to as a transducer 41. When the transducers 42-1 and 42-2 need not be distinguished individually, they will be simply referred to as a transducer 42. When the transducers 43-1 and 43-2 need not be distinguished individually, they will be simply referred to as a transducer 43.

Figure 2:
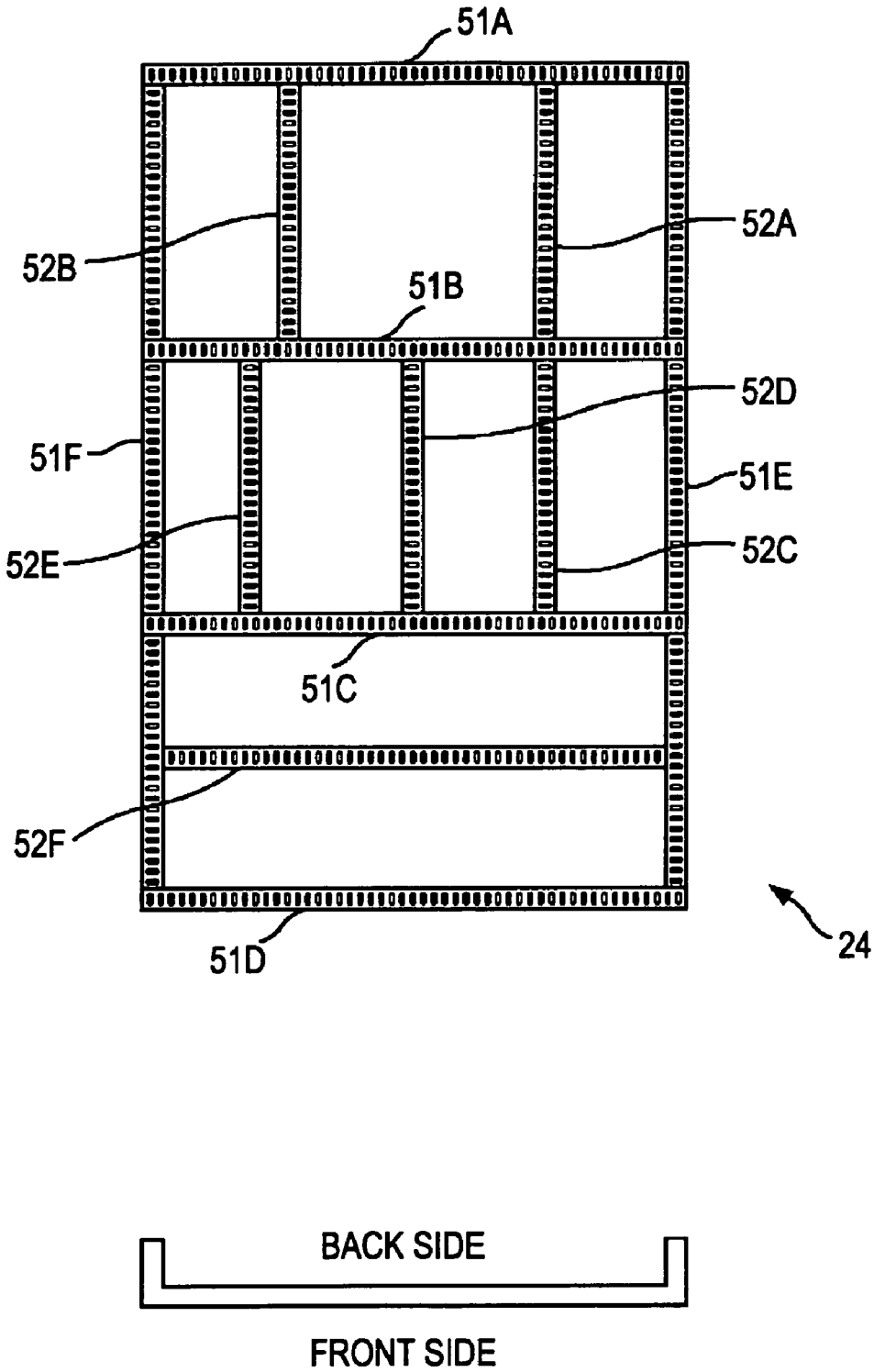
FIG. 2 illustrates details of a frame.

Next, a description will be given of details of the frame 24 with reference to FIG. 2. The diagram in the upper part of FIG. 2 shows a state in which the frame 24 shown in FIG. 1 is viewed from the front (the front side) of FIG. 1. The diagram in the lower part of FIG. 2 shows a state in which the frame 24 shown in FIG. 1 is viewed from above in FIG. 1. As shown in the diagram in the lower part of FIG. 2, the cross section of the frame 24 for fixing the oscillation enhancing panels 31-1 to 31-3 has the shape of the letter U.

As shown in the diagram in the upper part of FIG. 2, the frame 24 includes main frames 51A to 51F and subframes 52A to 52F.

The main frames 51A to 51F are each formed of, for example, a material such as a metal. Since the main frame 51D and the base 21 are fixed by welding, the frame 24 stands upright on the base 21.

Figure 3:
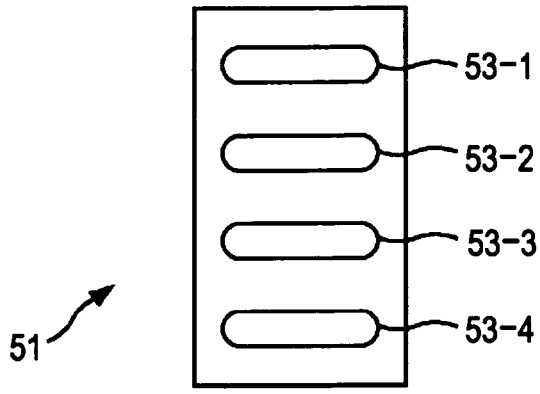
FIG. 3 illustrates details of a main frame.

Each of the main frames 51A to 51F is provided with long holes (or circular holes) at predetermined positions so that each of the subframes 52A to 52F can be freely arranged. These long holes are provided at predetermined positions so that the main frames 51A to 51F may be spaced evenly. For example, when part of the main frame 51 (main frames 51A to 51F) is enlarged and viewed, in the main frame 51, as shown in FIG. 3, the long holes 53-1 to 53-4, which are horizontally long holes, are spaced at predetermined intervals.

That is, in the frame 24, as shown in FIG. 2, each of the main frames 51A to 51D in the horizontal direction in the figure among the main frames 51A to 51F is provided with a vertically long hole, and the main frame 51E and the main frame 51F in the vertical direction are provided with a horizontally long hole.

Figure 4:
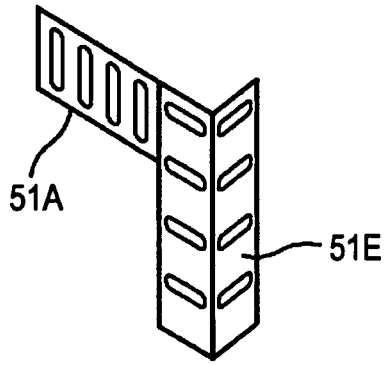
FIG. 4 illustrates an L-letter-shaped angle member.

The main frames 51E and 51F are formed as L-letter-shaped angle members, and are fixed by, for example, welding to each of the main frames 51A to 51D, which are straight members. For example, in the frame 24, as shown in FIG. 4, as a result of the straight main frame 51A and the L-letter-shaped main frame 51E being fixed together by welding, the cross section thereof has the shape of the letter U, as shown in the lower side of FIG. 2.

That is, since the frame 24 has the shape of the letter U, the long holes provided in each of the main frames 51E and 51F can be used from the front and also from the right and left sides in FIG. 2 (details of which will be described later).

Figure 5:
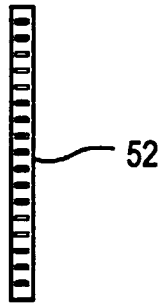
FIG. 5 illustrates the shape of a subframe.

A subframe 52 (subframes 52A to 52F) shown in FIG. 5 can be fixed to the long hole provided in each of the main frames 51A to 51F by using, for example, fasteners such as bolts and nuts. The subframes 52A to 52F are mounted on the main frames 51A to 51F, respectively, by means of fasteners.

That is, by removing the fastener, it is possible for the user to freely remove one of the subframes 52A to 52F mounted on the main frames 51A to 51F, respectively. Furthermore, also, a new subframe 52G (not shown) can be freely mounted on each of the main frames 51A to 51F by means of a fastener.

By mounting the subframes 52A to 52F onto the main frames 51A to 51F, respectively, the strength of the frame 24 can be increased. Furthermore, also, the sound quality can be varied by changing the size of the oscillation enhancing panel 31 and by reducing distortion of sound by functioning to hold down the oscillation enhancing panel 31 in accordance with the resonance point of the oscillation enhancing panel 31, that is, by suppressing the resonance point of the frequency of audio to be output. Since each of the subframes 52A to 52F supports the transducers 41-1 and 41-2, 42-1 and 42-2, and 43-1 and 43-2 from the back, it is also possible to more reliably transmit oscillation to each of the oscillation enhancing panels 31-1 to 31-3.

That is, each of the subframes 52A to 52F is provided to, for example, suppress the peak of the resonance point of the audio or to shift the frequency of the resonance point.

In the manner described above, in the screen speaker apparatus 11, the main frames 51A to 51F are mounted with the subframes 52A to 52F, respectively. As a result, the screen speaker apparatus 11 can reliably output audio from a low frequency to a high frequency.

In the following description, when the main frames 51A to 51F need not be distinguished individually, they will be simply referred to as a main frame 51. When the subframes 52A to 52F need not be distinguished individually, they will be simply referred to as a subframe 52.

In the above-described example, it has been assumed that the frame 24 is formed of six main frames 51A to 51F and six subframes 52A to 52F. In the embodiment of the present invention, any desired number of main frames 51 and subframes 52 can be provided, and also, each of the main frames 51 and the subframes 52 can be arranged at any desired position.

Furthermore, the subframe 52 may also be mounted in the oblique direction with respect to the main frame 51. Furthermore, the subframe 52 may also be formed, rather than in the shape of a straight line, for example, in the shape of the letter L, in the shape of the letter T, or in the shape of the letter U.

Figure 6:
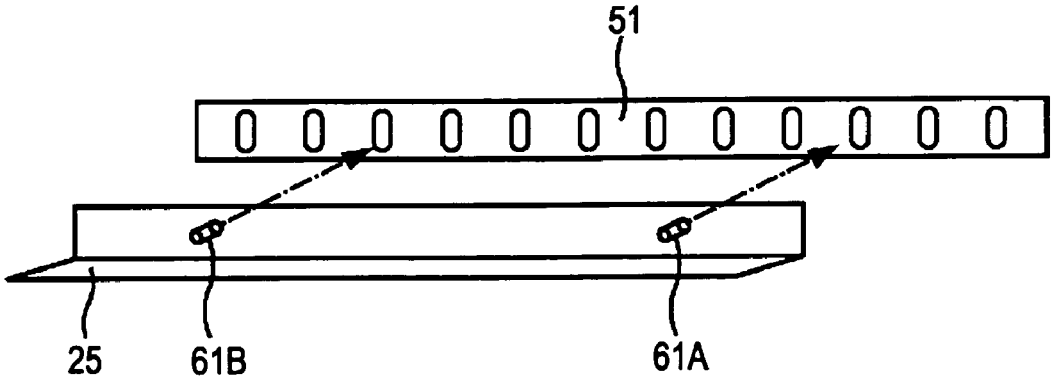
FIG. 6 illustrates details of a load-bearing oscillation enhancing panel support.
Figure 7:
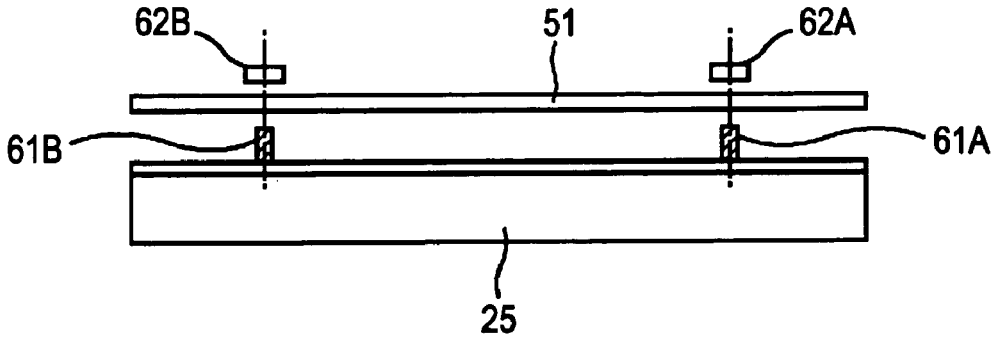
FIG. 7 illustrates detailed of a load-bearing oscillation enhancing panel support.

Next, a description is given, with reference to FIGS. 6 and 7, details of the load-bearing oscillation enhancing panel support 25. FIG. 6 is a perspective view obtained when the load-bearing oscillation enhancing panel support 25 is fixed to the main frame 51 of the frame 24. FIG. 7 shows a case in which the load-bearing oscillation enhancing panel support 25 and the main frame 51 of FIG. 6 are viewed from above.

The load-bearing oscillation enhancing panel support 25 is made of, for example, a material such as a metal. As shown in FIG. 6, the load-bearing oscillation enhancing panel support 25 is formed of an L-letter-shaped angle member. The L-letter-shaped angle member is provided with bolts 61A and 61B that can be fitted into the long hole provided in the main frame 51.

As shown in FIG. 7, in the frame 24, each of the bolts 61A and 61B of the load-bearing oscillation enhancing panel support 25 is fitted into a predetermined long hole of the main frame 51. The fitted bolts 61A and 61B are fixed by the nuts 62A and 62B, respectively.

That is, in the frame 24, the bolts 61A and 61B provided in the load-bearing oscillation enhancing panel support 25, which is an L-letter-shaped angle member, are fixed to the main frame 51 by means of the nuts 62A and 62B, thereby supporting the oscillation enhancing panel 31 in the weight direction (in the vertical direction). As a result, in the screen speaker apparatus 11, since the oscillation enhancing panel 31 is supported in the weight direction by the load-bearing oscillation enhancing panel support 25, the oscillation enhancing panel 31 does not fall in the weight direction.

Next, a description will be given, with reference to FIGS. 8 to 11, details the back-and-forth oscillation enhancing panel support 26.

Figure 8:
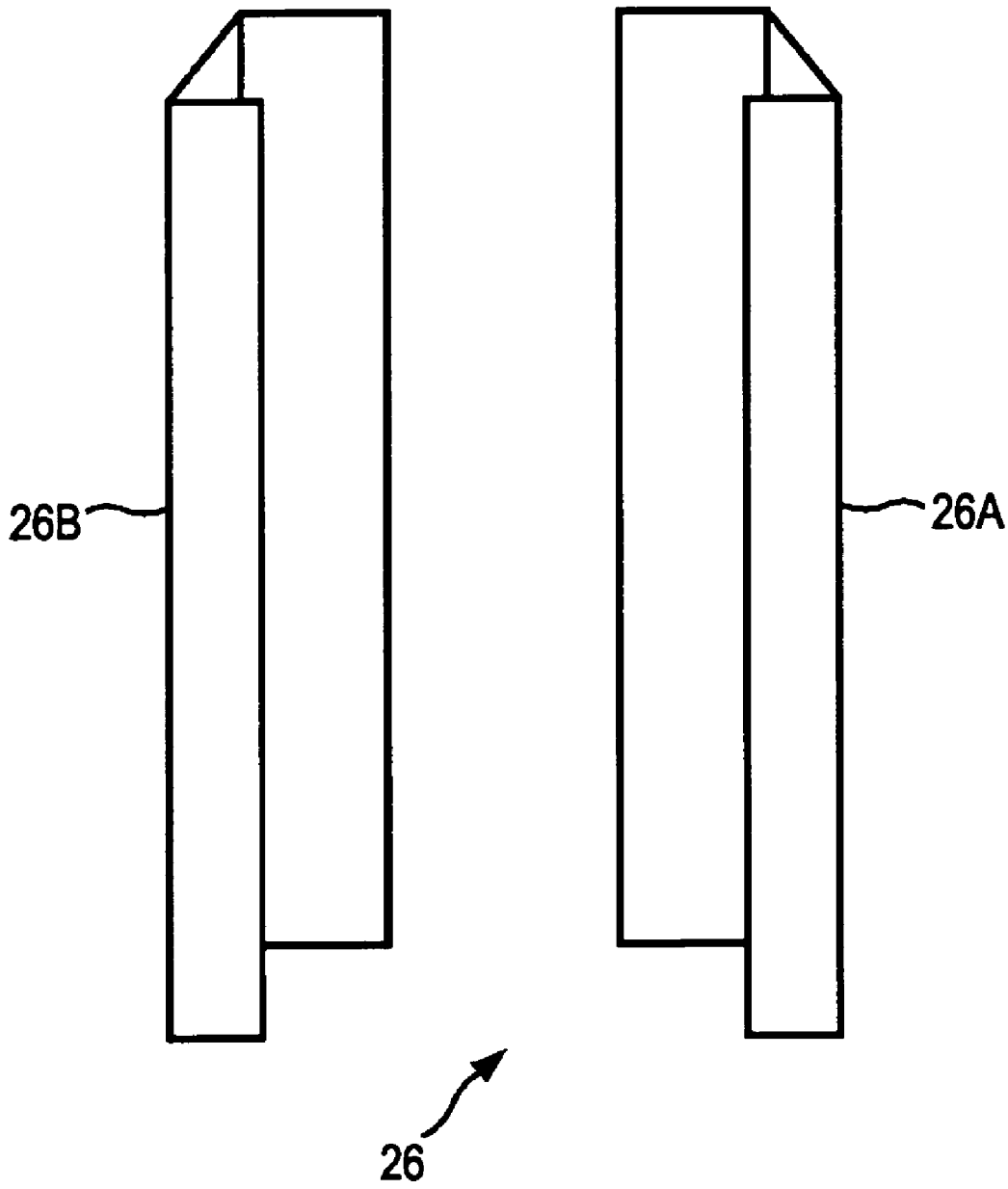
FIG. 8 illustrates the shape of a back-and-forth oscillation enhancing panel support.

The back-and-forth oscillation enhancing panel support 26 is made of, for example, a material such as a metal shown in FIG. 8. The back-and-forth oscillation enhancing panel support 26 is formed in the shape of the letter U and is removably mounted on the frame 24.

Figure 9:
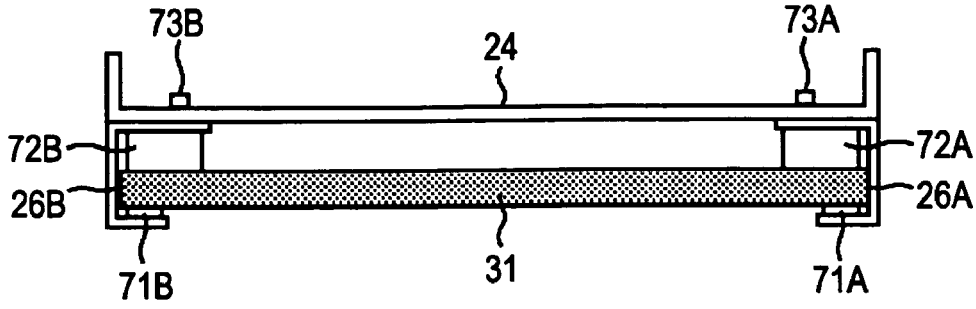
FIG. 9 illustrates details of a back-and-forth oscillation enhancing panel support.
Figure 10:
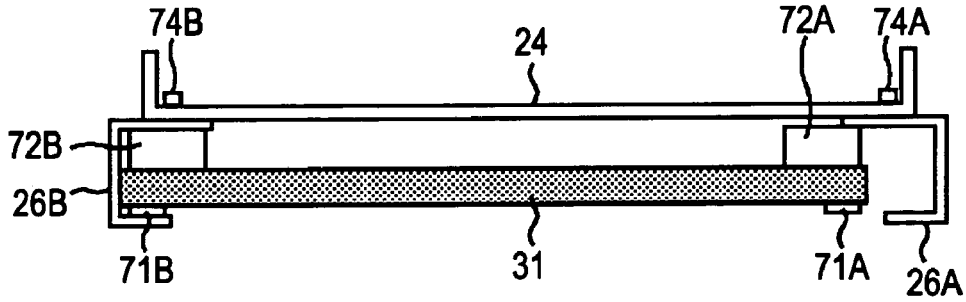
FIG. 10 illustrates details of a back-and-forth oscillation enhancing panel support.
Figure 11:
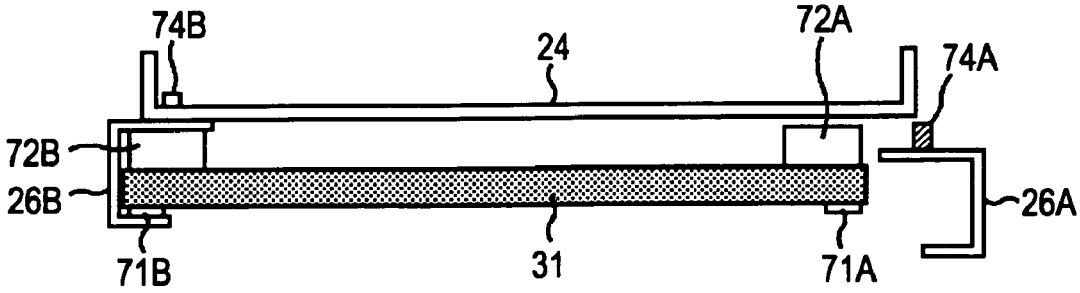
FIG. 11 illustrates details of a back-and-forth oscillation enhancing panel support.

As shown in FIGS. 9 to 11, the back-and-forth oscillation enhancing panel support 26 supports the oscillation enhancing panel 31 in a back-and-forth direction, the oscillation enhancing panel 31 being sandwiched by using the back-and-forth oscillation enhancing panel supports 26A and 26B by using the shape of the letter U thereof.

FIGS. 9 to 11 show a case in which the screen speaker apparatus 11 of FIG. 1 is viewed from above.

As shown in FIG. 9, for example, a predetermined number of bolts (not shown) that can be fitted into long holes provided in (the main frame 51 of) the frame 24 are provided in each of the back-and-forth oscillation enhancing panel supports 26A and 26B. These bolts are fitted into the long holes of the main frame 51 and are fixed by a number of nuts (in the example of FIG. 9, nuts 73A and 73B), the number of which corresponding to the number of bolts.

When the back-and-forth oscillation enhancing panel supports 26A and 26B are to sandwich the oscillation enhancing panel 31, they sandwich the oscillation enhancing panel 31 and also cushioning members in a predetermined shape (in FIG. 9, cushioning member 71A, 71B, 72A, and 72B) in such a manner that the oscillation enhancing panel 31 is further sandwiched thereby.

Each of the cushioning members 71A, 71B, 72A, and 72B is made of, for example, a material such as urethetane (sponge) or rubber. The hardness thereof can be adjusted from a high hardness to a low hardness in accordance with a desired sound quality and sound volume. The cushioning members 71A and 71B are provided in front of the oscillation enhancing panel 31, and the cushioning members 72A and 72B are provided in back of the oscillation enhancing panel 31, so that an impact exerted on the oscillation enhancing panel 31 is absorbed to protect the oscillation enhancing panel 31.

That is, the cushioning members 71A, 71B, 72A, and 72B are used to cushion the oscillation enhancing panel 31 or the frame 24, so that oscillation by the oscillation enhancing panel 31 and generation of audio are facilitated.

In the screen speaker apparatus 11, when the oscillation enhancing panel 31 is to be removed, as shown in FIG. 10, the back-and-forth oscillation enhancing panel support 26A is moved to the right side in FIG. 10 by removing the nut 73A from the bolt 74A provided in the back-and-forth oscillation enhancing panel support 26A and by allowing the bolt 74A that has become freely mobile to slide in the horizontal direction along the long hole of the main frame 51. Also, similarly, the back-and-forth oscillation enhancing panel support 26B is moved to the left side in FIG. 10 by removing the nut 73B from the bolt 74B and by allowing the bolt 74B to slide in the horizontal direction along the long hole of the main frame 51.

At this time, since the oscillation enhancing panel 31 is in a state of capable of being easily removed from the screen speaker apparatus 11, it is possible for the user to easily remove the oscillation enhancing panel 31.

Furthermore, as shown in FIG. 11, in addition to allowing each of the back-and-forth oscillation enhancing panel supports 26A and 26B to slide in the horizontal direction, the user may remove the oscillation enhancing panel 31 after one of the back-and-forth oscillation enhancing panel supports 26A and 26B is removed.

As described above, in the screen speaker apparatus 11, since the oscillation enhancing panel 31 can be freely removed, it is possible for the user to change the thickness (depth) of the oscillation enhancing panel 31 to a desired thickness.

Figure 12:
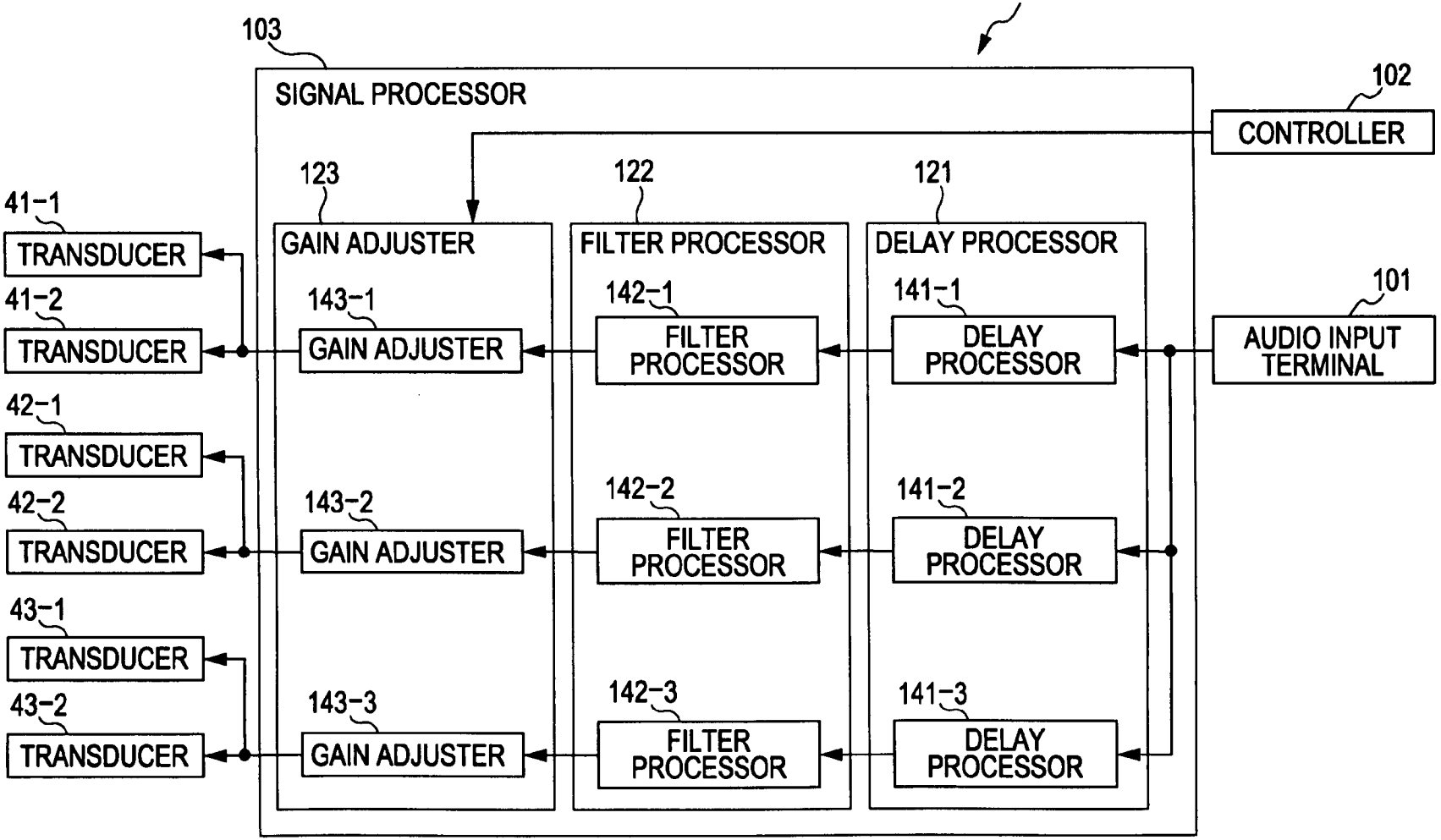
FIG. 12 is a block diagram showing an example of the configuration of a screen speaker apparatus.

FIG. 12 is a block diagram showing an example of the configuration of the screen speaker apparatus 11 to which an embodiment of the present invention is applied. Components in FIG. 12, which correspond to those in FIG. 11, are designated with the same reference numerals, and descriptions thereof are omitted where appropriate. In FIG. 12, the illustration of the oscillation enhancing panel 31 and the like shown in FIG. 1 is omitted.

The screen speaker apparatus 11 includes an audio input terminal 101, a controller 102, a signal processor 103, and transducers 41-1 and 41-2, 42-1 and 42-2, and 43-1 and 43-2.

The audio input terminal 101 is connected to a playback apparatus for playing back audio from a CD (Compact Disc), a DVD (Digital Versatile Disc), etc., a radio, a microphone, or the like. The audio input terminal 101 supplies an audio signal supplied from the connected playback apparatus, the radio, the microphone or the like to the signal processor 103. For example, an audio signal among the audio signals of one of 2-channel and 5.1-channel is input to the audio input terminal 101.

The controller 102 generates a control signal for controlling the gain of the audio that is output by each of the oscillation enhancing panels 31 and supplies the control signal to the signal processor 103.

The signal processor 103 is formed of, for example, a DSP (Digital Signal Processor), an MPU (Micro Processing Unit), and the like. Under the control of the controller 102, the signal processor 103 performs predetermined processing on an audio signal input from the audio input terminal 101 and supplies the audio signal obtained by the processing to the transducers 41-1 and 41-2, 42-1 and 42-2, and 43-1 and 43-2.

On the basis of the audio signal supplied from the signal processor 103, each of the transducers 41-1 and 41-2, 42-1 and 42-2, and 43-1 and 43-2 allows the oscillation enhancing panel 31, in which the transducers 41-1 and 41-2, 42-1 and 42-2, and 43-1 and 43-2 are disposed, to oscillate. As a result, the oscillation enhancing panel 31 outputs audio.

The signal processor 103 includes delay processor 121, a filter processor 122, and a gain adjuster 123.

The delay processor 121 includes a delay processors 141-1 to 141-3. Each of the delay processors 141-1 to 141-3 performs a process for causing a delay by a predetermined amount of delay (delay process) on an audio signal supplied from the audio input terminal 101, and supplies the audio signal on which the delay process has been performed to the filter processor 122.

The filter processor 122 includes filter processors 142-1 to 142-3. Each of the filter processors 142-1 to 142-3 performs a filtering process for causing an audio signal of a predetermined frequency bandwidth to pass or to be blocked by using a filter, such as an FIR (Finite Impulse Response) filter and an IIR (Infinite Impulse Response) filter, on an audio signal supplied from each of the delay processors 141-1 to 141-3. Each of the filter processors 142-1 to 142-3 supplies the audio signal on which the filtering process has been performed to the gain adjuster 123.

The gain adjuster 123 includes gain adjusters 143-1 to 143-3. On the basis of the control signal supplied from the controller 102, each of the gain adjusters 143-1 to 143-3 performs a gain adjustment process for adjusting the gain on the basis of the audio signal that is input and for limiting the range of the audio level of the audio signal to be output, on the audio signal supplied from each of the filter processors 142-1 to 142-3.

The gain adjuster 143-1 supplies the audio signal on which the gain adjustment process has been performed to the transducers 41-1 and 41-2. The gain adjuster 143-2 supplies the audio signal on which the gain adjustment process has been performed to the transducers 42-1 and 42-2. The gain adjuster 143-3 supplies the audio signal on which the gain adjustment process has been performed to the transducers 43-1 and 43-2.

In the following description, when the delay processors 141-1 to 141-3 need not be distinguished individually, they will be simply referred to as a delay processor 141. When the filter processors 142-1 to 142-3 need not be distinguished individually, they will be simply referred to as a filter processor 142. When the gain adjusters 143-1 to 143-3 need not be distinguished individually, they will be simply referred to as a gain adjuster 143.

In the foregoing, it has been assumed that each of the delay processor 141, the filter processor 142, and the gain adjuster 143 performs a predetermined processing on an audio signal supplied to each of the transducers 41-1 and 41-2, 42-1 and 42-2, and 43-1 and 43-2. In the embodiment of the present invention, all the processes need not be performed, for example, only the delay process by the delay processor 141 may be performed on the audio signal.

In the above-described example, in order to facilitate the understanding of the description, the delay processor 121 is provided with the delay processors 141-1 to 141-3, the filter processor 122 is provided with the filter processors 142-1 to 142-3, and the gain adjuster 123 is provided with the gain adjusters 143-1 to 143-3. Alternatively, one processor (for example, the delay processor 121, the filter processor 122, or the gain adjuster 123) may perform each process.

As shown in FIG. 1, the screen speaker apparatus 11 includes the three oscillation enhancing panels 31-1 to 31-3, and the positions at which the transducers are mounted differ for each oscillation enhancing panel 31.

Figure 13A:
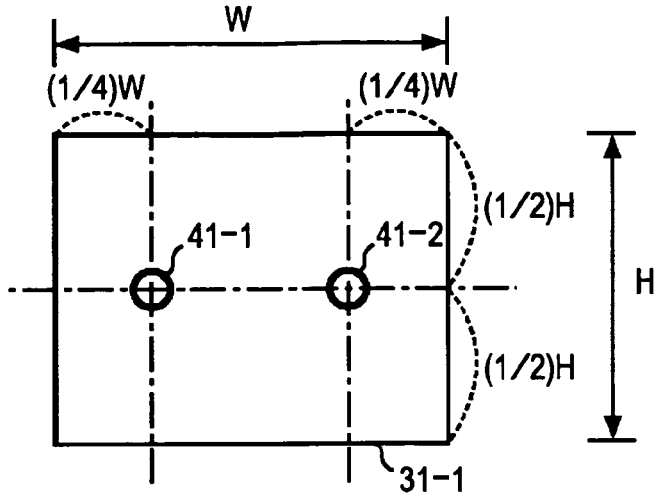
FIGS. 13A, 13B, and 13C illustrate the position of a transducer arranged in an oscillation enhancing panel.
Figure 13B:
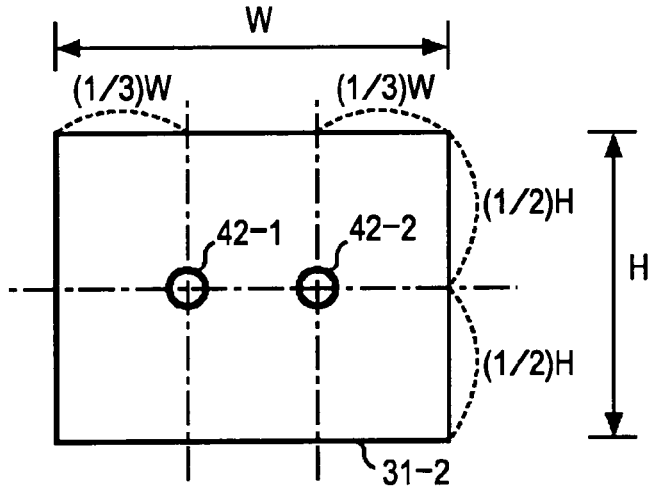
Figure 13C:
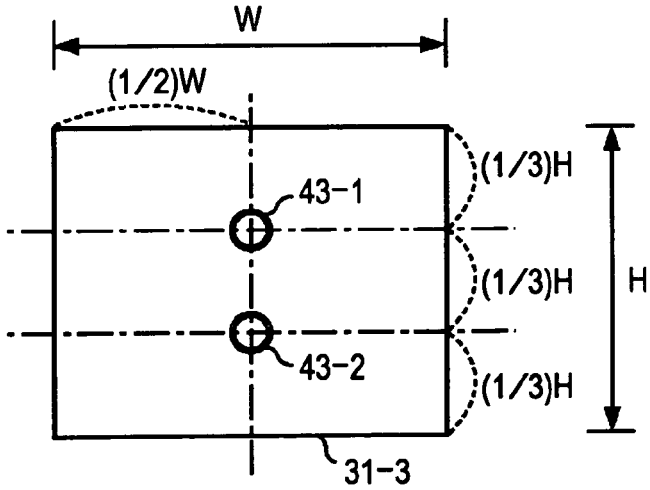

For example, when the length of the oscillation enhancing panel 31 in the vertical direction (in the up-and-down direction of FIG. 1) is denoted as H and the length thereof in the horizontal direction (in the left-and-right direction in FIG. 1) is denoted as W, the transducers are arranged at positions on the oscillation enhancing panel 31 shown in FIGS. 13A, 13B, and 13C. FIG. 13A shows the position of the transducer 41 arranged in the oscillation enhancing panel 31-1. FIG. 13B shows the position of the transducer 42 arranged in the oscillation enhancing panel 31-2. FIG. 13C shows the position of the transducer 43 arranged in the oscillation enhancing panel 31-3.

In FIG. 13A, the transducer 41-1 is arranged at a position at which the distance from the transducer 41-1 to the left end of the oscillation enhancing panel 31-1 of the oscillation enhancing panel 31-1 is (¼)W and the distance from the transducer 41-1 to the upper end is (½)H. The transducer 41-2 is arranged at a position at which the distance from the transducer 41-2 to the right end of the oscillation enhancing panel 31-1 is (¼)W and the distance from the transducer 41-2 to the upper end of the oscillation enhancing panel 31-1 is (½)H.

That is, the transducers 41-1 and 41-2 are arranged side by side in the oscillation enhancing panel 31-1 in the horizontal direction in such a manner as to be spaced apart by a distance of (½)W.

Furthermore, as shown in FIG. 13B, the transducer 42-1 is arranged at a position at which the distance from the transducer 42-1 to the left end of the oscillation enhancing panel 31-2 is (⅓)W and the distance from the transducer 42-1 to the upper end of the oscillation enhancing panel 31-2 is (½)H. The transducer 42-2 is arranged at a position at which the distance from the transducer 42-2 to the right end of the oscillation enhancing panel 31-2 is (⅓)W and the distance from the transducer 42-2 to the upper end of the oscillation enhancing panel 31-2 is (½)H.

That is, the transducers 42-1 and 42-2 are arranged in the oscillation enhancing panel 31-2 side by side in the horizontal direction in such a manner as to be spaced apart by a distance of (⅓)W.

As shown in FIG. 13C, the transducer 43-1 is arranged at a position at which the distance from the transducer 43-1 to the left end of the oscillation enhancing panel 31-3 is (½)W and the distance from the transducer 43-1 to the upper end of the oscillation enhancing panel 31-3 is (⅓)H. The transducer 43-2 is arranged at a position at which the distance from the transducer 43-2 to the left end of the oscillation enhancing panel 31-3 is (½)W and the distance from the transducer 43-2 to the lower end of the oscillation enhancing panel 31-3 is (⅓)H.

That is, in the oscillation enhancing panel 31-3, the transducers 43-1 and 43-2 are arranged side by side in the vertical direction in such a manner as to be spaced apart by a distance of (⅓)H.

Each of the oscillation enhancing panels 31-1 to 31-3 shown in FIGS. 13A to 13C is constituted of, for example, a plate-shaped MDF with a length (the size of H) of 745 mm in the vertical direction, a length (the size of W) of 910 mm in the horizontal direction, and a thickness (the depth in FIG. 13) of 5 mm.

As described above, even if the material and the size of the oscillation enhancing panels 31-1 to 31-3 are made the same, by setting the position of the transducer in the oscillation enhancing panel 31, in which a predetermined position (for example, the center of the oscillation enhancing panel 31) is used as a reference, to a position that differs for each oscillation enhancing panel 31, the oscillation exciting position in each of the oscillation enhancing panels 31-1 to 31-3 can be made a different position. Therefore, each of the oscillation enhancing panels 31-1 to 31-3 oscillates, and the frequency characteristics of audio that is output by the oscillated oscillation enhancing panels 31-1 to 31-3 become different.

A description will be given below, with reference to FIGS. 14 to 18, of frequency characteristics of the screen speaker apparatus 11.

Figure 14:
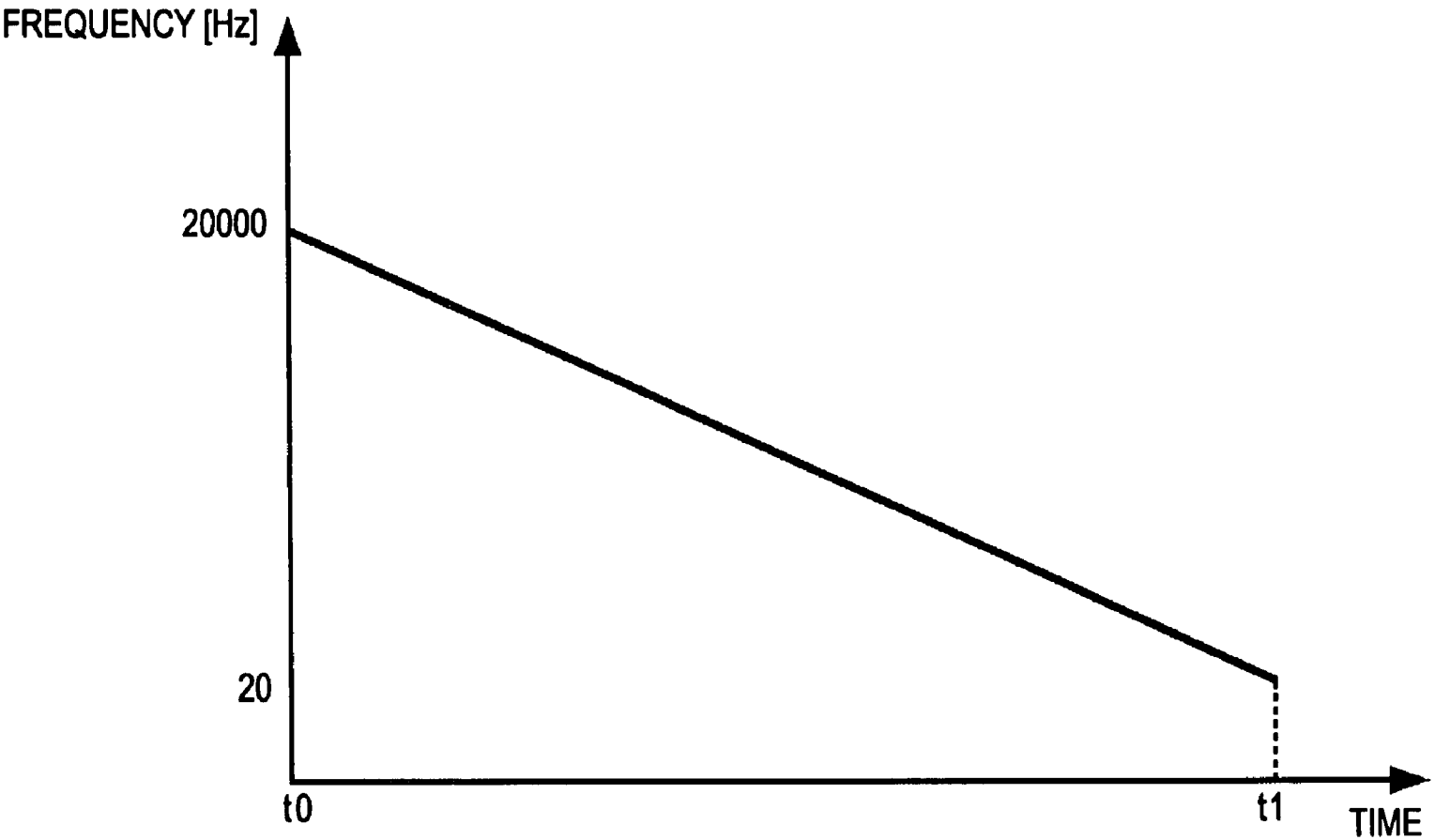
FIG. 14 illustrates an audio signal input to an audio input terminal.

As shown in FIG. 14, the frequency characteristics of the screen speaker apparatus 11 can be obtained, for example, by inputting an audio signal of a sweep waveform, whose sound volume (audio level) is constant and whose frequency changes linearly with the passage of time, to the audio input terminal 101 (FIG. 12) in order to allow audio to be output from the oscillation enhancing panel 31, and by measuring the output audio.

In the example of FIG. 14, the frequency of the audio signal input to the audio input terminal 101 is 20000 Hz at time t0. The frequency decreases linearly with the passage of time and becomes 20 Hz at time t1. Such an audio signal is input to the audio input terminal 101 and is supplied to the transducers 41 to 43 via the signal processor 103 in order to allow audio to be output from the screen speaker apparatus 11. Then, when the audio is measured, measurement results (frequency characteristics) shown in FIGS. 15 to 18 are obtained.

At this time, the following are assumed. In the signal processor 103, the delay process, the filter process, and the gain adjustment process are not performed. Furthermore, each of the oscillation enhancing panels 31-1 to 31-3 used for measurements is set as the oscillation enhancing panel 31 shown in FIGS. 13A to 13C. The height of each oscillation enhancing panel 31 (the size of H of FIG. 13) is set to 745 mm. The width of each oscillation enhancing panel 31 (the size of W of FIG. 13) is set to 910 mm. The thickness (the depth of FIG. 13) is set to 5 mm. The oscillation enhancing panel 31 is made of an MDF.

Figure 15:
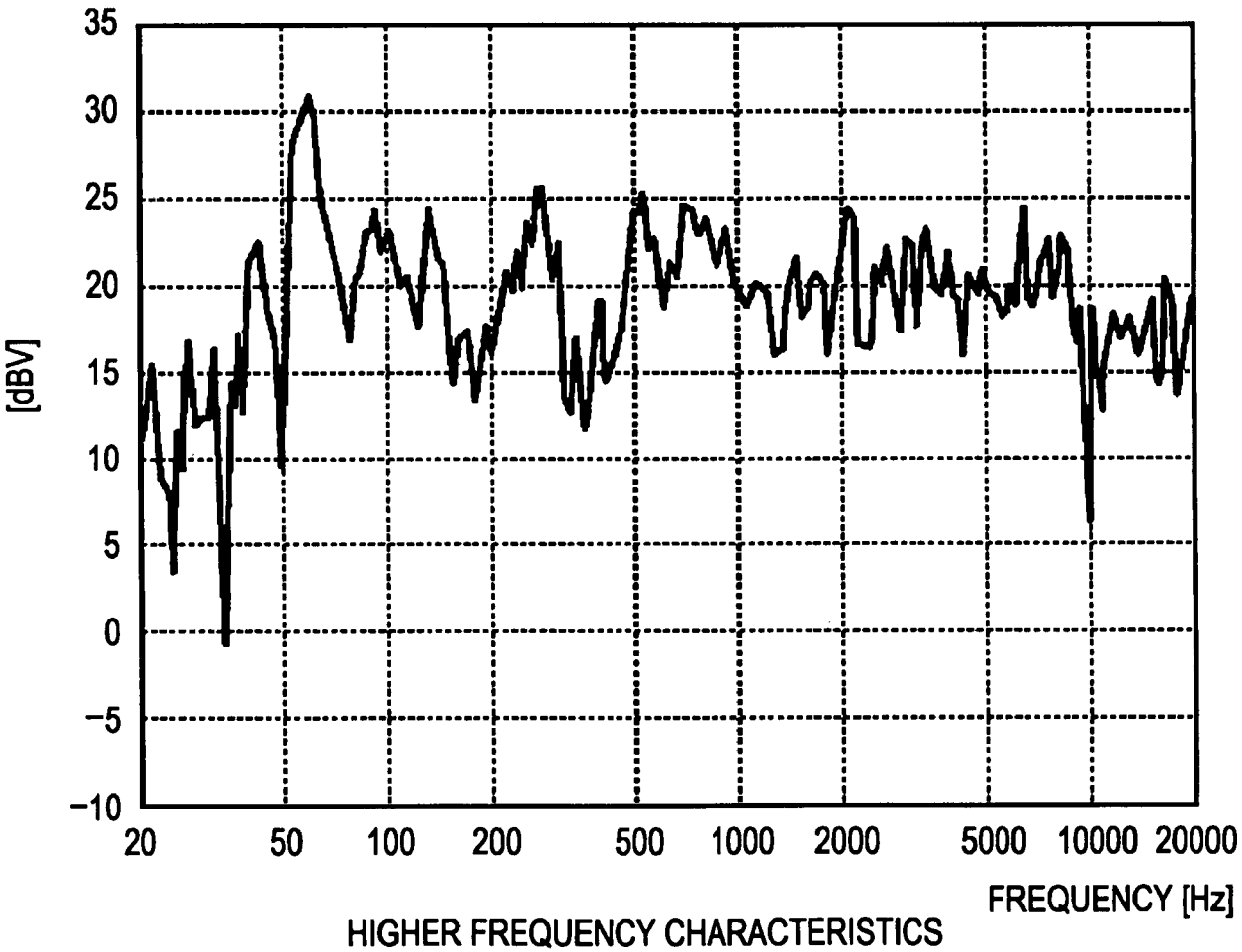
FIG. 15 shows frequency characteristics of an oscillation enhancing panel.

FIG. 15 shows the frequency characteristics of the oscillation enhancing panel 31-1, which are obtained by measuring audio that is output by the transducers 41-1 and 41-2 by allowing the oscillation enhancing panel 31-1 shown in FIG. 13A to oscillate on the basis of the audio signal shown in FIG. 14. The audio measurement position is set to a position of 1 m from the center of the oscillation enhancing panel 31-1 of FIG. 1 toward the front side.

In FIG. 15, the vertical axis shows the audio level (sound volume) of measured audio, and the horizontal axis shows the frequency of the measured audio. In the example of FIG. 15, it can be seen that the audio level in the vicinity of 63 Hz is higher than the audio level of the other frequencies and that audio in the vicinity of 63 Hz is output at a sound volume larger than the audio of the other frequencies. Furthermore, in the vicinity of 3000 Hz to 8000 Hz, changes in the audio level are comparatively small, and flatter frequency characteristics are obtained when compared to the other frequency bandwidths.

Furthermore, at 150 Hz and 250 Hz, the audio level is changed sharply, and the audio level at 150 Hz to 250 Hz is decreased greatly than the audio level of neighborhood frequencies. Similarly, also, at 300 Hz and 500 Hz, the audio level is changed sharply, and the audio level at 300 Hz to 500 Hz is decreased greatly than the audio level of frequencies in the neighborhood. As described above, when the audio level of frequency bandwidths in the neighborhood of a certain degree of widths is decreased greatly than the audio level of neighborhood frequencies, the listener does not perceive audio of a frequency bandwidth that is lower than the neighborhood audio level of the frequencies.

Figure 16:
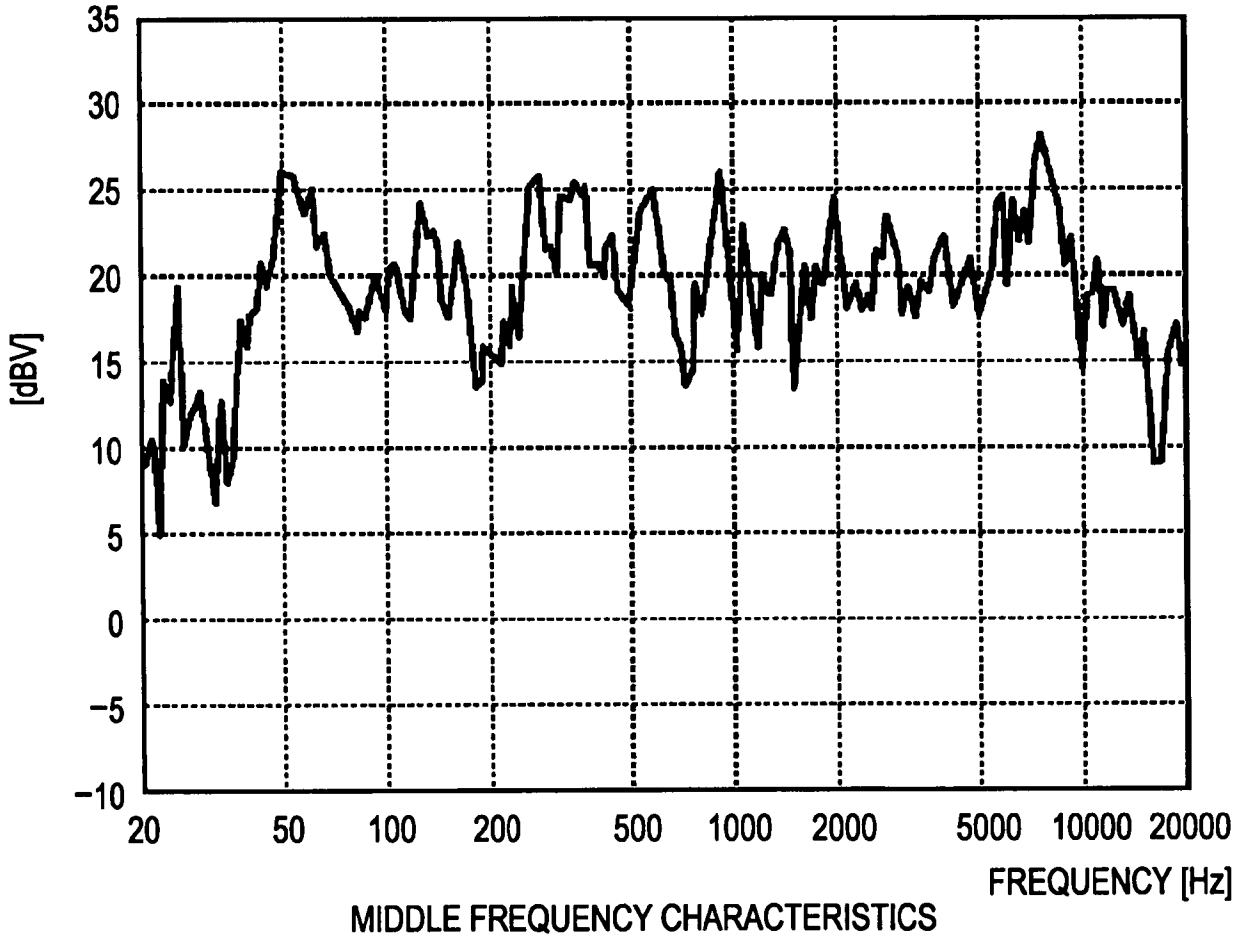
FIG. 16 shows frequency characteristics of an oscillation enhancing panel.

FIG. 16 shows frequency characteristics of the oscillation enhancing panel 31-2, which are obtained by measuring audio that is output by the transducers 42-1 and 42-2 by allowing the oscillation enhancing panel 31-2 shown in FIG. 13B to oscillate on the basis of the audio signal shown in FIG. 14. The audio measurement position is set to a position of 1 m from the center of the oscillation enhancing panel 31-2 of FIG. 1 toward the front side.

In FIG. 16, the vertical axis shows the audio level (sound volume) of measured audio, and the horizontal axis shows the frequency of the measured audio. In the example of FIG. 16, at 175 Hz and 300 Hz, the audio level is changed sharply, and the audio level of 175 Hz to 300 Hz is greatly decreased than the audio level of the neighborhood frequencies. In the vicinity of 1000 Hz to 5000 Hz, changes in the audio level are comparatively small, and flatter frequency characteristics are obtained when compared to the other frequency bandwidths.

Since human hearing is most sensitive to audio in the vicinity of 1000 Hz to 3000 Hz, by setting frequency characteristics in the frequency range of 1000 Hz to 3000 Hz of the oscillation enhancing panel 31-2 arranged at the height of the ears of the listener (height in the up-and-down direction in FIG. 1) to be comparatively close to flat, it is possible for the listener to perceive that the frequency characteristics of audio that is output from the screen speaker apparatus 11 are close to flat. Furthermore, also, when audio is not output from the oscillation enhancing panels 31-1 and 31-3 and audio is output only from the oscillation enhancing panel 31-2, similarly, it is possible for the listener to perceive that the frequency characteristics of audio that is output from the screen speaker apparatus 11 are close to flat.

Figure 17:
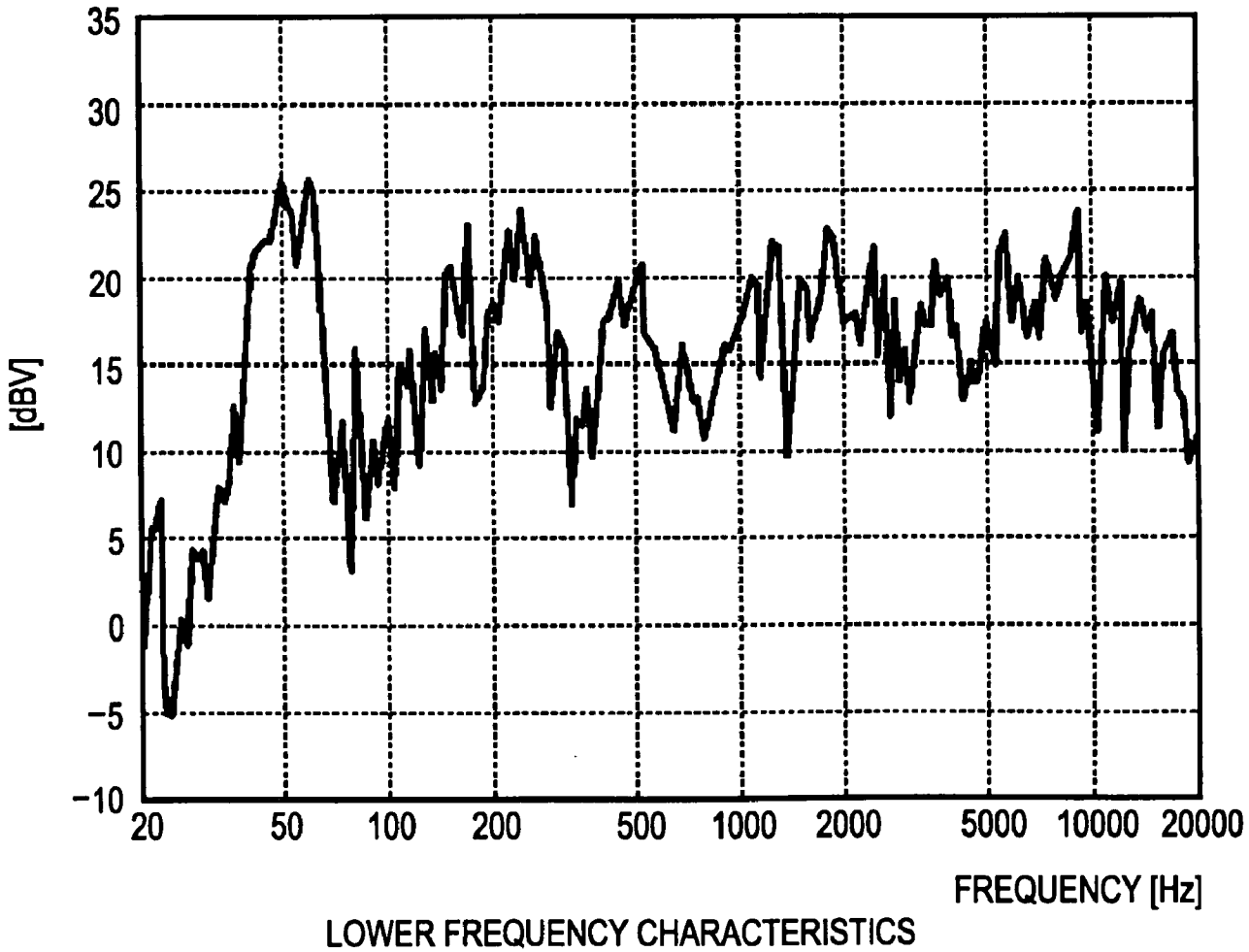
FIG. 17 shows frequency characteristics of an oscillation enhancing panel.

FIG. 17 shows the frequency characteristics of the oscillation enhancing panel 31-3, which are obtained by the transducers 43-1 and 43-2 by allowing the oscillation enhancing panel 31-3 shown in FIG. 13C to oscillate on the basis of the audio signal shown in FIG. 14. The audio measurement position is set to a position of 1 m from the center of the oscillation enhancing panel 31-3 of FIG. 1 toward the front side.

In FIG. 17, the vertical axis shows the audio level (sound volume) of measured audio, and the horizontal axis shows the frequency of the measured audio. In the example of FIG. 17, the changes in the audio level with frequency are marked compared with those in the case of the oscillation enhancing panels 31-1 and 31-2 shown in FIGS. 15 and 16, and the audio level in the vicinity of 200 Hz (150 Hz to 300 Hz) is higher than the neighborhood audio level.

Figure 18:
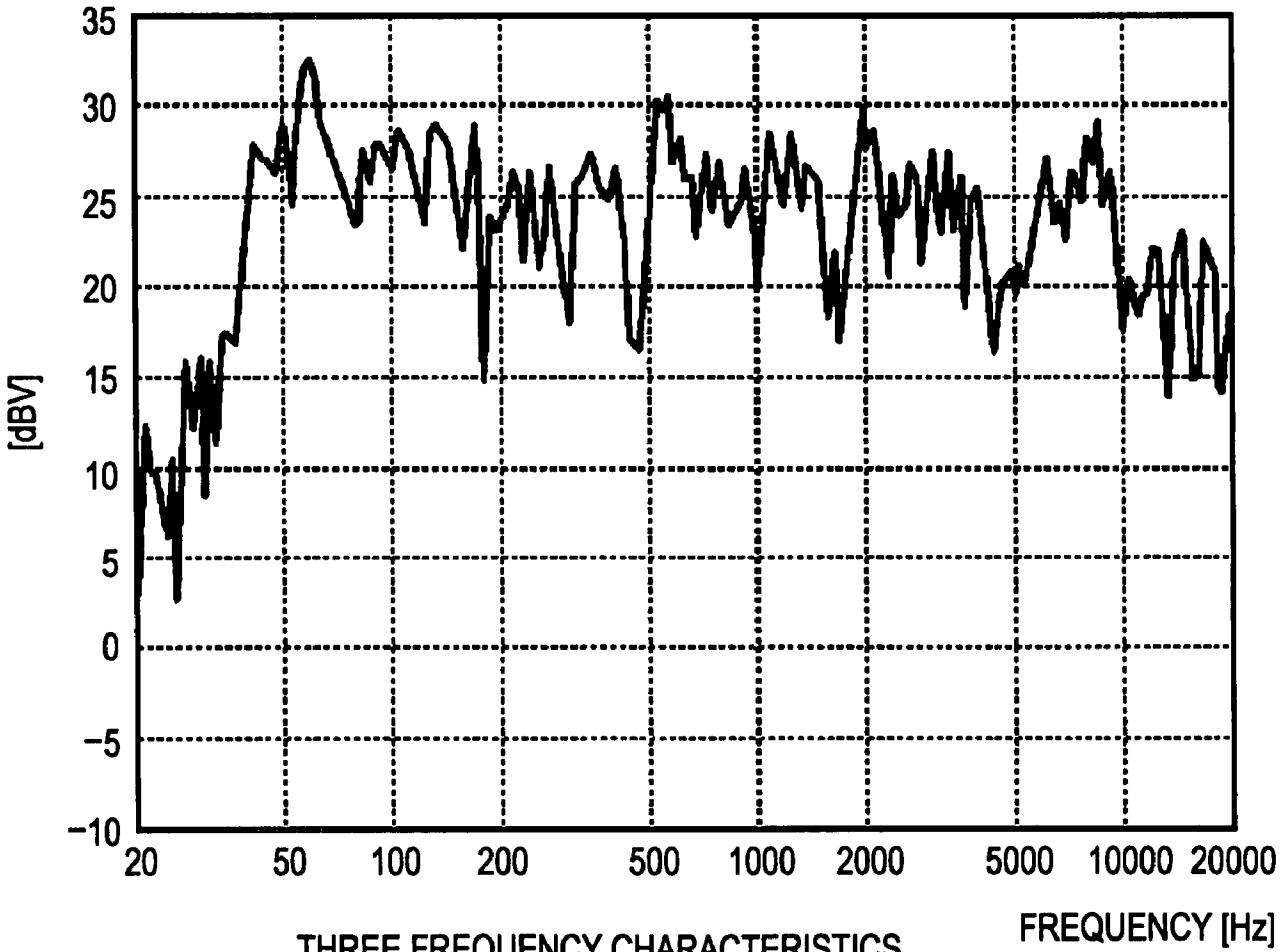
FIG. 18 shows frequency characteristics of a screen speaker apparatus.

FIG. 18 shows frequency characteristics of the screen speaker apparatus 11, which are obtained by measuring audio that is output by each of the transducers 41, 42, and 43 by allowing each of the oscillation enhancing panels 31-1 to 31-3 shown in FIGS. 13A to 13C to simultaneously oscillate on the basis of the audio signal shown in FIG. 14. The audio measurement position is set to a position of 1 m from the center of the oscillation enhancing panel 31-2 of FIG. 1 toward the front side.

In FIG. 18, the vertical axis shows the audio level (sound volume) of the measured audio, and the horizontal axis shows the frequency of the measured audio. In the example of FIG. 18, when compared to the respective frequency characteristics of the oscillation enhancing panels 31-1 to 31-3, which are shown in FIGS. 15 to 17, changes in the audio level are small as a whole and is close to flat. More specifically, the level of audio that is output by the screen speaker apparatus 11 is approximately 27 dBV at 50 Hz to 10000 Hz.

For example, as described above, the audio level of frequency characteristics of the oscillation enhancing panels 31-1 and 31-2, which are shown in FIGS. 15 and 16, is lower than that of the frequencies in the neighborhood in the vicinity of 200 Hz, but the audio level of frequency characteristics of the oscillation enhancing panel 31-3 shown in FIG. 17 is higher than that of frequencies in the neighborhood in the vicinity of 200 Hz. As a result, by combining the oscillation enhancing panels 31-1 to 31-3 and outputting audio at the same time, the audio level of the screen speaker apparatus 11 in the vicinity of 200 Hz can be made nearly the same as the audio level of the frequencies in the neighborhood, as shown in FIG. 18.

As described above, in the screen speaker apparatus 11, by combining three oscillation enhancing panels 31 having mutually different frequency characteristics of audio to be output, the frequency characteristics of the screen speaker apparatus 11 can be made flatter. The position of the transducer arranged in each of the three oscillation enhancing panels 31 constituting the screen speaker apparatus 11 is determined so that the frequency characteristics of the audio that is output by the screen speaker apparatus 11 become flatter when audio is output simultaneously from each oscillation enhancing panel 31.

Furthermore, in the screen speaker apparatus 11, by only adjusting the gain of an audio signal to be input to (the transducer attached in) the predetermined oscillation enhancing panel 31, it is possible to more easily amplify or attenuate the audio level of a specific frequency bandwidth.

For example, since the audio level in the vicinity of 63 Hz of the oscillation enhancing panel 31-1 shown in FIG. 15 is higher than the audio level of the other frequencies, a gain adjustment process is not performed on the audio signal input to the transducer attached in the oscillation enhancing panels 31-2 and 31-3, and a gain adjustment process is performed on the audio signal input to the transducer 41 attached in the oscillation enhancing panel 31-1. Therefore, it is possible to amplify or attenuate the audio level in the vicinity of 63 Hz of audio that is output by the screen speaker apparatus 11.

In the related art, when the audio level of a predetermined frequency bandwidth of audio that is output by an audio output apparatus is to be amplified or attenuated, the audio level of the frequency bandwidth is adjusted by performing a filtering process by using a filter coefficient, which is held in advance, for relatively amplifying or attenuating the audio level of a frequency bandwidth desired to be adjusted by the amount of a predetermined audio level. In this case, the audio output apparatus wants a filter coefficient that differs for each amount of adjustment with which the audio level is adjusted even at the same frequency band.

In comparison, in the screen speaker apparatus 11, by only performing a gain adjustment process on the audio signal input to the transducer attached in the oscillation enhancing panel 31 whose audio level of the frequency bandwidth desired to be adjusted is highest among the three oscillation enhancing panels 31, it is possible to easily adjust the audio level of the desired frequency bandwidth.

Furthermore, in the screen speaker apparatus 11, by only combining a plurality of oscillation enhancing panels 31 having different frequency characteristics, it is possible to make the frequency characteristics of the screen speaker apparatus 11 flatter without performing a filtering process on the audio signal. Therefore, a delay of the audio signal as a result of performing a filtering process does not occur.

Moreover, the frequency characteristics of each of the oscillation enhancing panels 31 constituting the screen speaker apparatus 11 can easily be changed by changing the material, the fixation method, the size, or the shape of the oscillation enhancing panel; the position of the transducer fixed to the oscillation enhancing panel 31; or the number of transducers.

Figure 19:
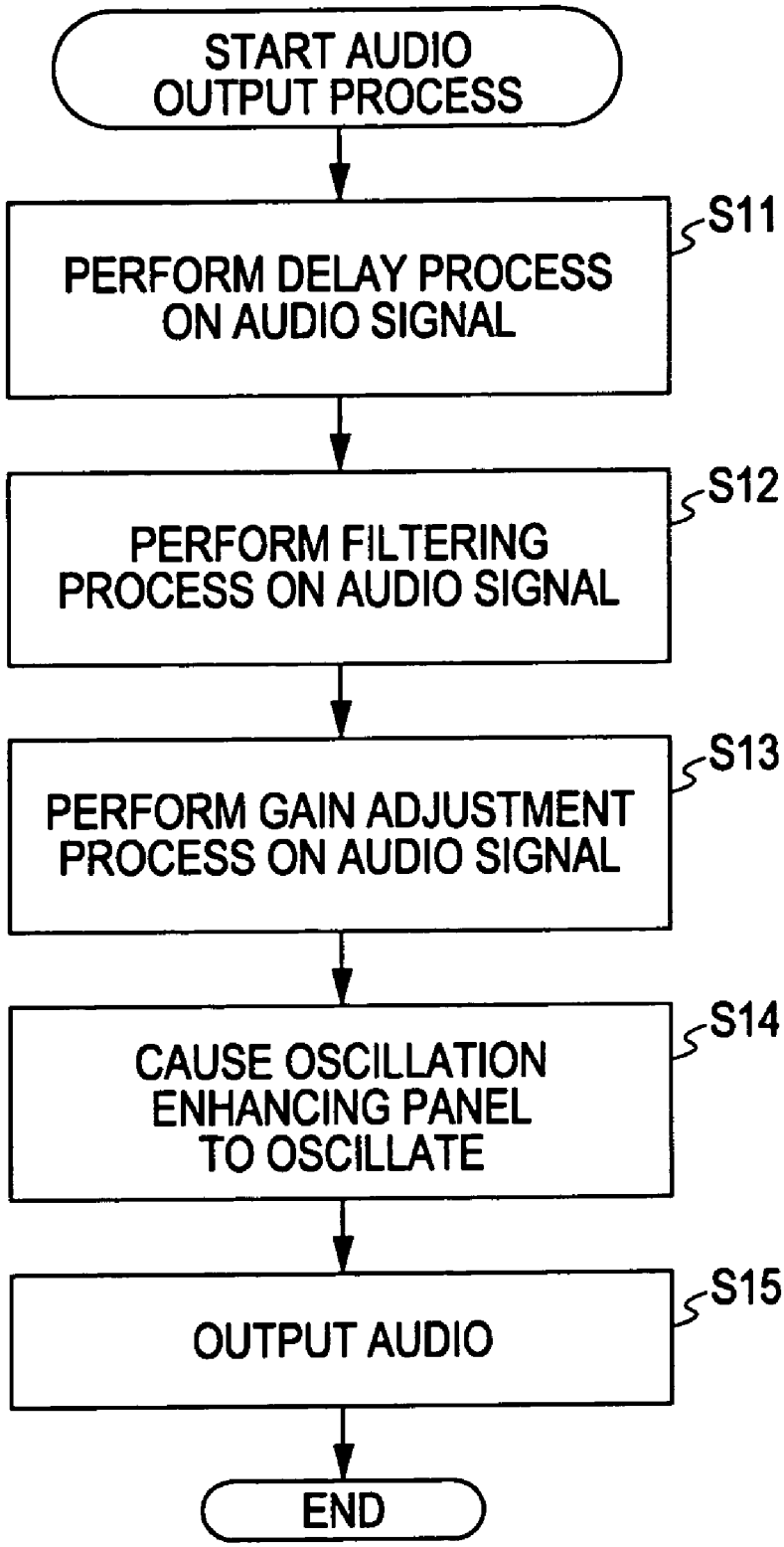
FIG. 19 is a flowchart illustrating an audio output process.

Next, a description will be given, with reference to the flowchart in FIG. 19, of an audio output process to be performed by the screen speaker apparatus 11.

The audio output process begins when an audio signal is input to the audio input terminal 101 and the audio signal is supplied to the delay processor 141 (delay processors 141-1 to 141-3).

When the audio signal is input from the audio input terminal 101 to the delay processor 141, in step S11, the delay processor 141 performs a delay process on the audio signal supplied from the audio input terminal 101 and supplies the delayed audio signal to the filter processor 142.

In step S12, the filter processor 142 performs a filtering process for passing or blocking an audio signal of a predetermined frequency bandwidth on the audio signal supplied from the delay processor 141, and supplies the audio signal on which the filtering process has been performed to the gain adjuster 143.

In step S12, the same filtering process may also be performed on each audio signal input to each of the filter processors 142-1 to 142-3, or a different filtering process may also be performed.

For example, the following may be performed. A filtering process for passing only the audio signal of a frequency higher than 5000 Hz is performed on the audio signal input to the filter processor 142-1. A filtering process for passing only the audio signal of a frequency higher than or equal to 500 Hz or lower than or equal to 5000 Hz is performed on the audio signal input to the filter processor 142-2. A filtering process for passing only the audio signal of a frequency lower than 500 Hz is performed on the audio signal input to the filter processor 142-3.

As described above, in each filter processor 142, by performing a filtering process for passing only the audio signal of a frequency bandwidth that differs for each filter processor 142, it is possible for each oscillation enhancing panel 31 to output only the audio of a predetermined frequency bandwidth that differs for each oscillation enhancing panel 31.

Therefore, by only adjusting the gain by each gain adjuster 143 at a subsequent stage, it is possible to more easily make the frequency characteristics of audio that is output by the screen speaker apparatus 11 flatter and possible to adjust the level of the audio of a desired frequency bandwidth. In this case, the filter processor 142 needs only to hold one predetermined filter coefficient and needs not to hold a plurality of filter coefficients.

When the filtering process is performed on the audio signal in step S12, in step S13, on the basis of a control signal supplied from the controller 102, the gain adjuster 143 performs a gain adjustment process for limiting the range of the level of the audio signal to be output, on the audio signal supplied from the filter processor 142, and supplies the signal to the transducer attached in the oscillation enhancing panel 31.

More specifically, the gain adjuster 143-1 supplies the audio signal on which the gain adjustment process has been performed to the transducers 41-1 and 41-2. The gain adjuster 143-2 supplies the audio signal on which the gain adjustment process has been performed to the transducers 42-1 and 42-2. The gain adjuster 143-3 supplies the audio signal on which the gain adjustment process has been performed to the transducers 43-1 and 43-2.

In step S14, on the basis of the audio signal supplied from each of the gain adjusters 143-1 to 143-3, the transducers 41 to 43 allow the oscillation enhancing panels 31-1 to 31-3 to oscillate, respectively.

In step S15, the oscillation enhancing panels 31-1, 31-2, and 31-3 are made to oscillate by the transducers 41, 42, and 43, respectively, thereby outputting audio. Then, the audio output process is completed.

The delay process, the filtering process, and the gain adjustment process, which are performed in steps S11 to S13, respectively, may also not be performed when they are not particularly necessary.

In the manner described above, the screen speaker apparatus 11 performs a predetermined process as necessary on the input audio signal, and allows each of a plurality of oscillation enhancing panels 31 having different frequency characteristics to oscillate on the basis of the audio signal, thereby outputting audio.

As described above, by allowing each of a plurality of oscillation enhancing panels 31 having different frequency characteristics to oscillate to output audio, it is possible to make frequency characteristics of audio that is output become flatter. Furthermore, by adjusting the gain of the audio signal input to the transducer attached in a predetermined oscillation enhancing panel 31, it is possible to more easily adjust the sound volume of the desired frequency bandwidth.

In the foregoing, an example has been described in which the materials and sizes of a plurality of oscillation enhancing panels 31 constituting the screen speaker apparatus 11 are the same, and the frequency characteristics of each oscillation enhancing panel 31 are made different by changing the position of the transducer attached in the oscillation enhancing panel 31. Alternatively, the positions of the transducers arranged in the plurality of oscillation enhancing panels constituting the screen speaker apparatus 11 may be the same, and the frequency characteristics of the oscillation enhancing panel may be made different by making the material of each oscillation enhancing panel different.

Figure 20:
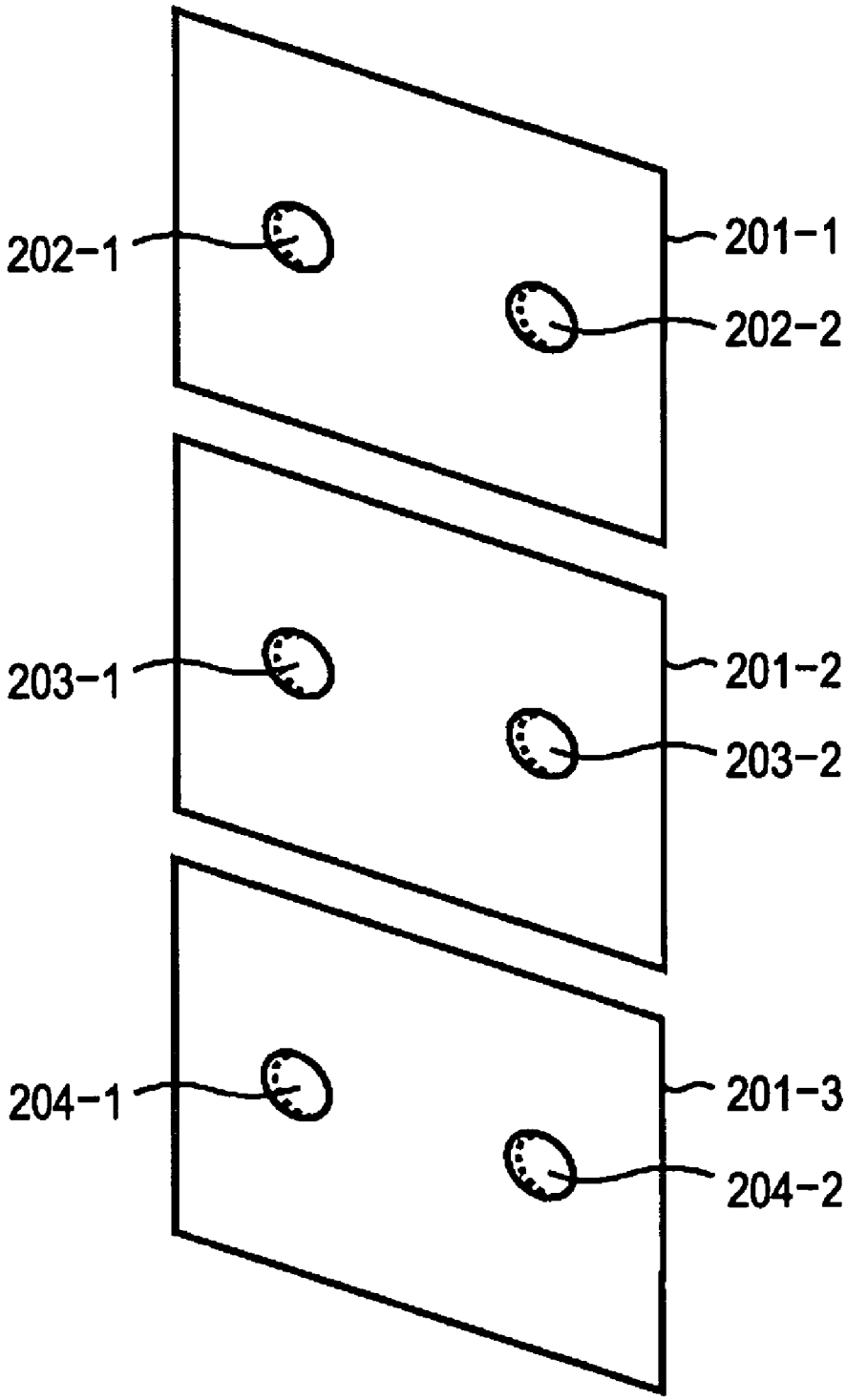
FIG. 20 illustrates the positions of transducers arranged in oscillation enhancing panels.

In such a case, for example, as shown in FIG. 20, the oscillation enhancing panels 201-1 to 201-3 constituting the screen speaker apparatus 11 have the same size, and only the material differs.

Furthermore, on the oscillation enhancing panel 201-1, transducers 202-1 and 202-2 are arranged side by side in the horizontal direction in FIG. 20. Furthermore, in the oscillation enhancing panel 201-2, transducers 203-1 and 203-2 are arranged side by side in the horizontal direction in FIG. 20 at positions corresponding to the transducers 202-1 and 202-2 on the oscillation enhancing panel 201-1, respectively. Similarly, in the oscillation enhancing panel 201-3, transducers 204-1 and 204-2 are arranged side by side in the horizontal direction in FIG. 20 at positions corresponding to the transducers 202-1 and 202-2 in the oscillation enhancing panel 201-1, respectively.

In the following, when the oscillation enhancing panels 201-1 to 201-3 need not be distinguished individually, they will be simply referred to as an oscillation enhancing panel 201. When the transducers 202-1 and 202-2 need not be distinguished individually, they will be simply referred to as a transducer 202. When the transducers 203-1 and 203-2 need not be distinguished individually, they will be simply referred to as a transducer 203. When the transducers 204-1 and 204-2 need not be distinguished individually, they will be simply referred to as a transducer 204.

Here, the material of each oscillation enhancing panel 201 can be selected according to the frequency characteristics of which frequency bandwidth of audio that is output by the oscillation enhancing panel 201 should be made flatter or according to the audio level of which frequency bandwidth should be made higher than the other frequencies.

For example, when the oscillation enhancing panel 201 is formed of plywood, expanded polystyrene or the like, the following is ascertained by the applicant of the present invention: the frequency characteristics at higher frequencies, specifically, higher than or equal to 5000 Hz, of audio that is output can become flatter than those of an oscillation enhancing panel of another material, and the audio level higher than or equal to 5000 Hz can become higher than the audio level of the other frequencies.

When the oscillation enhancing panel 201 is formed of an acryl plate, a wood, or the like, the following is ascertained by the applicant of the present invention: the frequency characteristics at middle frequencies, specifically, higher than or equal to 500 Hz and lower than or equal to 5000 Hz, of audio that is output can become flatter than those of an oscillation enhancing panel of another material, and the audio level higher than or equal to 500 Hz and lower than or equal to 5000 Hz can become higher than the audio level of the other frequencies.

Furthermore, when the oscillation enhancing panel 201 is formed of a synthetic resin such as vinyl chloride, the following is ascertained by the applicant of the present invention: the frequency characteristics at lower frequencies, specifically, lower than or equal to 500 Hz, of audio that is output can become flatter than those of an oscillation enhancing panel of another material, and the audio level lower than or equal to 500 Hz can become higher than the audio level of the other frequencies.

Furthermore, the frequency characteristics of the oscillation enhancing panel 201 may also be changed by changing the size, the thickness, the shape, and the like of each oscillation enhancing panel 201.

By increasing the size of the oscillation enhancing panel 201, which is determined by the height and width thereof, the frequency characteristics of a lower frequency bandwidth of audio that is output by the oscillation enhancing panel 201 can become flatter, and the audio level of the lower frequency bandwidth can be made higher than the audio level of the other frequencies.

In other words, the smaller the size of the oscillation enhancing panel 201, the flatter the frequency characteristics of a higher frequency bandwidth of audio that is output by the oscillation enhancing panel 201 can become, and the audio level of a higher frequency bandwidth can be made higher than the audio level of the other frequencies.

The thicker the thickness (the depth in FIG. 20) of the oscillation enhancing panel 201, the flatter the frequency characteristics of a higher frequency bandwidth of audio that is output by the oscillation enhancing panel 201 can become, and the audio level of a higher frequency bandwidth can be made higher than the audio level of the other frequencies.

In other words, the thinner the thickness of the oscillation enhancing panel 201, the flatter the frequency characteristics of a lower frequency bandwidth of audio that is output by the oscillation enhancing panel 201 can become, and the audio level of a lower frequency bandwidth can be made higher than the audio level of the other frequencies.

Furthermore, by changing an fixation end (fixation place) for fixing each oscillation enhancing panel 201, the frequency characteristics of the oscillation enhancing panel 201 may be changed.

That is, when the number of places at which the oscillation enhancing panel 201 is fixed is increased, the frequency characteristics of a higher frequency bandwidth of audio that is output by the oscillation enhancing panel 201 can become flatter, and the audio level of a higher frequency bandwidth can become higher than the audio level of the other frequencies.

Figure 21A:
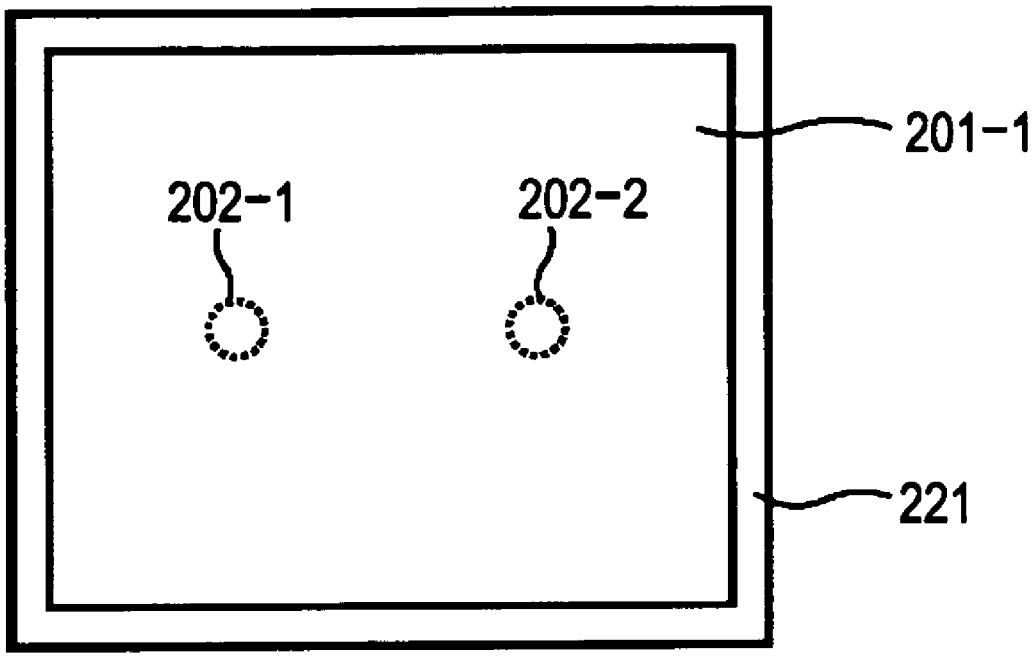
FIGS. 21A and 21B illustrate a method of fixing an oscillation enhancing panel.

For example, as shown in FIG. 21A, when the upper, lower, left, and right ends in the oscillation enhancing panel 201-1 are fixed by a support member 221, the frequency characteristics at higher frequencies (higher than or equal to 5000 Hz) of audio that is output by the oscillation enhancing panel 201-1 can become flatter, and the level of the audio at higher frequencies (higher than or equal to 5000 Hz) can become higher than the audio level of the other frequencies.

Figure 21B:
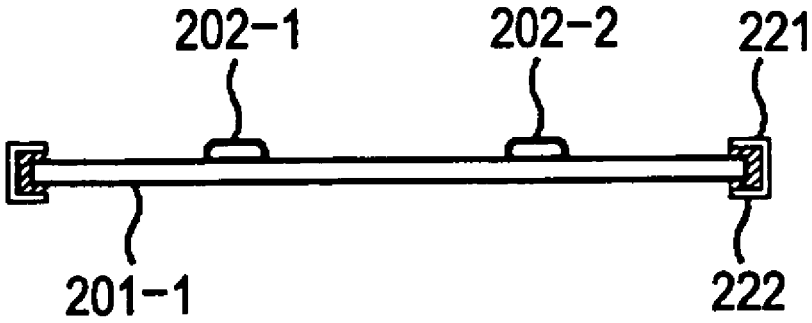

As shown in FIG. 21B, a cushioning member 222 is arranged between the oscillation enhancing panel 201-1 and the support member 221. FIG. 21B is a sectional view of the oscillation enhancing panel 201-1 when the oscillation enhancing panel 201-1 shown in FIG. 21A is viewed from below toward above and the support member 221.

In FIG. 21B, the end of the oscillation enhancing panel 201-1 is enclosed by the cushioning member 222, and the cushioning member 222 is enclosed by the support member 221, so that the oscillation enhancing panel 201-1 is fixed to the support member 221. Here, the greater the elasticity of the cushioning member 222 and the harder the cushioning member 222, the flatter the frequency characteristics of higher frequencies (higher than or equal to 5000 Hz) of audio that is output by the oscillation enhancing panel 201-1 have become, and the level of the audio at higher frequencies (higher than or equal to 5000 Hz) becomes higher than the audio level of the other frequencies.

In comparison, when the number of places at which the oscillation enhancing panel 201 is fixed is decreased (the greater the number of free ends in the oscillation enhancing panel 201), the frequency characteristics of a lower frequency bandwidth of audio that is output by the oscillation enhancing panel 201 can become flatter, and the audio level of a lower frequency bandwidth can be made higher than the audio level of the other frequencies.

Figure 22A:
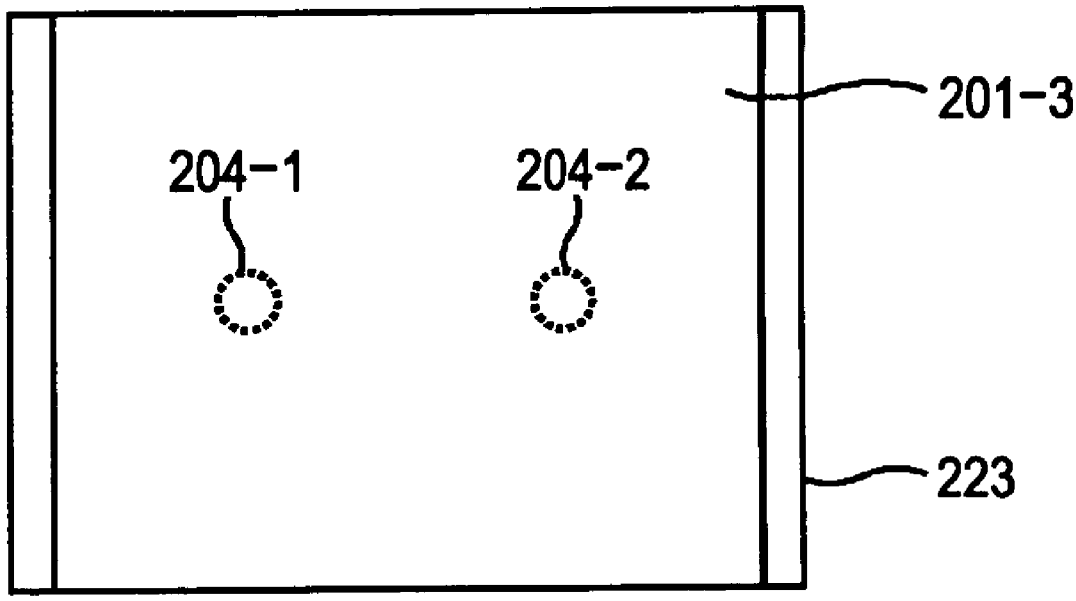
FIGS. 22A and 22B illustrate a method of fixing an oscillation enhancing panel.

For example, as shown in FIG. 22A, when the left and right ends of the oscillation enhancing panel 201-3 are fixed by the support member 223, the frequency characteristics at lower frequencies (lower than or equal to 500 Hz) of the audio that is output by the oscillation enhancing panel 201-3 become flatter, and the level of the audio at lower frequencies (lower than or equal to 500 Hz) becomes higher than the audio level of the other frequencies.

Figure 22B:
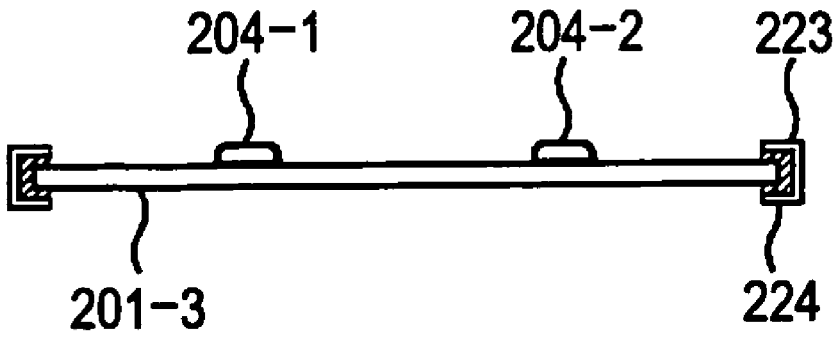

As shown in FIG. 22B, a cushioning member 224 is arranged between the oscillation enhancing panel 201-3 and the support member 223. FIG. 22B is a sectional view of the oscillation enhancing panel 201-3 when the oscillation enhancing panel 201-3 shown in FIG. 22A is viewed from below toward above and the support member 223.

In FIG. 22B, the end of the oscillation enhancing panel 201-3 is enclosed by the cushioning member 224, and the cushioning member 224 is enclosed by the support member 223, so that the oscillation enhancing panel 201-3 is fixed to the support member 223. Here, the smaller the elasticity of the cushioning member 224 and the softer the cushioning member 224, the flatter the frequency characteristics at lower frequencies (lower than or equal to 500 Hz) of the audio that is output by the oscillation enhancing panel 201-3 become, and the level of the audio at lower frequencies (lower than or equal to 500 Hz) becomes higher than the audio level of the other frequencies.

Furthermore, the frequency characteristics of the audio that is output by each oscillation enhancing panel may also be made different by changing the size of each oscillation enhancing panel constituting the screen speaker apparatus 11 and the position of the transducer arranged in the oscillation enhancing panel.

Figure 23:
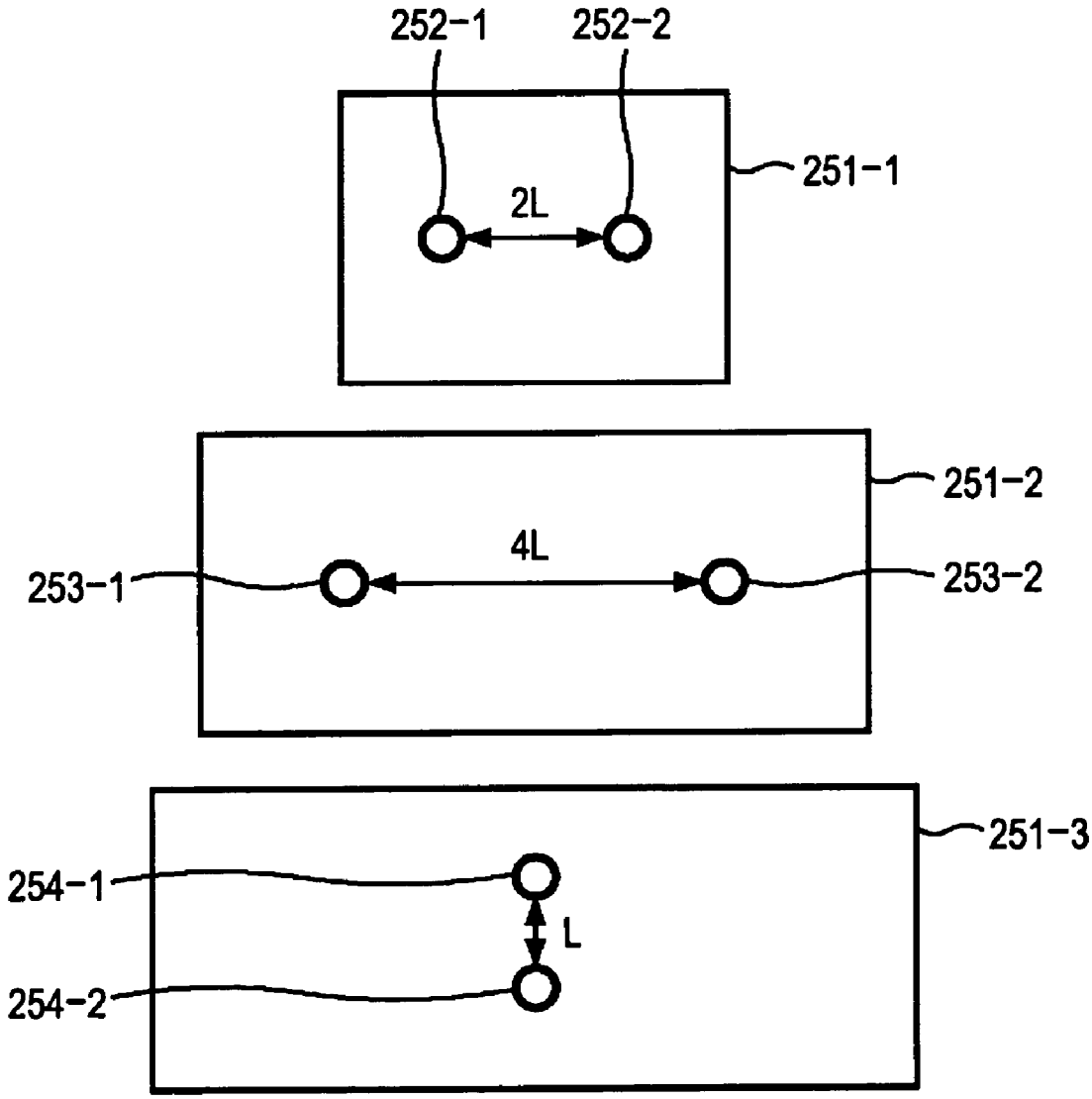
FIG. 23 illustrates the positions of transducers arranged in oscillation enhancing panels.

In such a case, for example, as shown in FIG. 23, the oscillation enhancing panels 251-1 to 251-3 constituting the screen speaker apparatus 11 and having a different size are arranged side by side.

In FIG. 23, the oscillation enhancing panels 251-1 to 251-3 are arranged side by side in the vertical direction in the figure. The size (the area of the surface of the oscillation enhancing panel, which is determined by the length in the vertical direction and the length in the horizontal direction in the figure) of each of the oscillation enhancing panels 251-1 to 251-3 are larger in the order of the oscillation enhancing panels 251-1 to 251-3.

In the oscillation enhancing panel 251-1, the transducers 252-1 and 252-2 are arranged side by side in the horizontal direction in the figure in such a manner as to be spaced apart by a distance of 2L. Here, the transducer 252-1 in the oscillation enhancing panel 251-1 is at a position spaced by L to the left in the figure from the center of the oscillation enhancing panel 251-1, and the transducer 252-2 in the oscillation enhancing panel 251-1 at a position spaced by L to the right in the figure from the center of the oscillation enhancing panel 251-1.

In the oscillation enhancing panel 251-2 larger than the oscillation enhancing panel 251-1, the transducer 253-1 and the transducer 253-2 are arranged side by side in the horizontal direction in the figure in such a manner as to be spaced apart by a distance of 4L. Here, the transducer 253-1 in the oscillation enhancing panel 251-2 is at a position spaced apart by a distance of 2L to the left in the figure from the center of the oscillation enhancing panel 251-2. The transducer 253-2 in the oscillation enhancing panel 251-2 is at a position spaced apart by a distance of 2L to the right in the figure from the center of the oscillation enhancing panel 251-2.

In the largest oscillation enhancing panel 251-3, transducers 254-1 and 254-2 are arranged side by side in the vertical direction in the figure in such a manner as to be spaced apart by a distance of L. Here, the transducer 254-1 in the oscillation enhancing panel 251-3 is at a position spaced apart by a distance of (½)L in the upward direction in the figure from the center of the oscillation enhancing panel 251-3. The transducer 254-2 in the oscillation enhancing panel 251-3 is at a position spaced apart by a distance of (½)L in the downward direction in the figure from the center of the oscillation enhancing panel 251-3.

As described above, for the oscillation enhancing panels constituting the screen speaker apparatus 11, the oscillation enhancing panels 251-1 to 251-3 having a mutually different size are used. The position of the transducer arranged in each of the oscillation enhancing panels 251-1 to 251-3 is made a position differing from the position corresponding to the position at which another transducer in another oscillation enhancing panel is arranged by using the center of each of the oscillation enhancing panels 251-1 to 251-3 as a reference. This also makes it possible to make different the frequency characteristics of the audio that is output by each of the oscillation enhancing panels 251-1 to 251-3.

As described above, by combining the oscillation enhancing panels 251-1 to 251-3 having different frequency characteristics as appropriate, the frequency characteristics of the audio that is output by the screen speaker apparatus 11 can become flatter.

As described above, in the embodiment of the present invention, since oscillation enhancing panels having different frequency characteristics are combined and audio is output from each oscillation enhancing panel, the frequency characteristics of the audio that is output can become flatter. As a result, it is possible to more accurately reproduce the input audio.

In the embodiment of the present invention, since oscillation enhancing panels having different frequency characteristics are combined and audio is output from each oscillation enhancing panel, it is possible to more easily adjust the sound volume of a desired frequency bandwidth by adjusting the gain of an audio signal input to a transducer attached in a predetermined oscillation enhancing panel.

Figure 24:
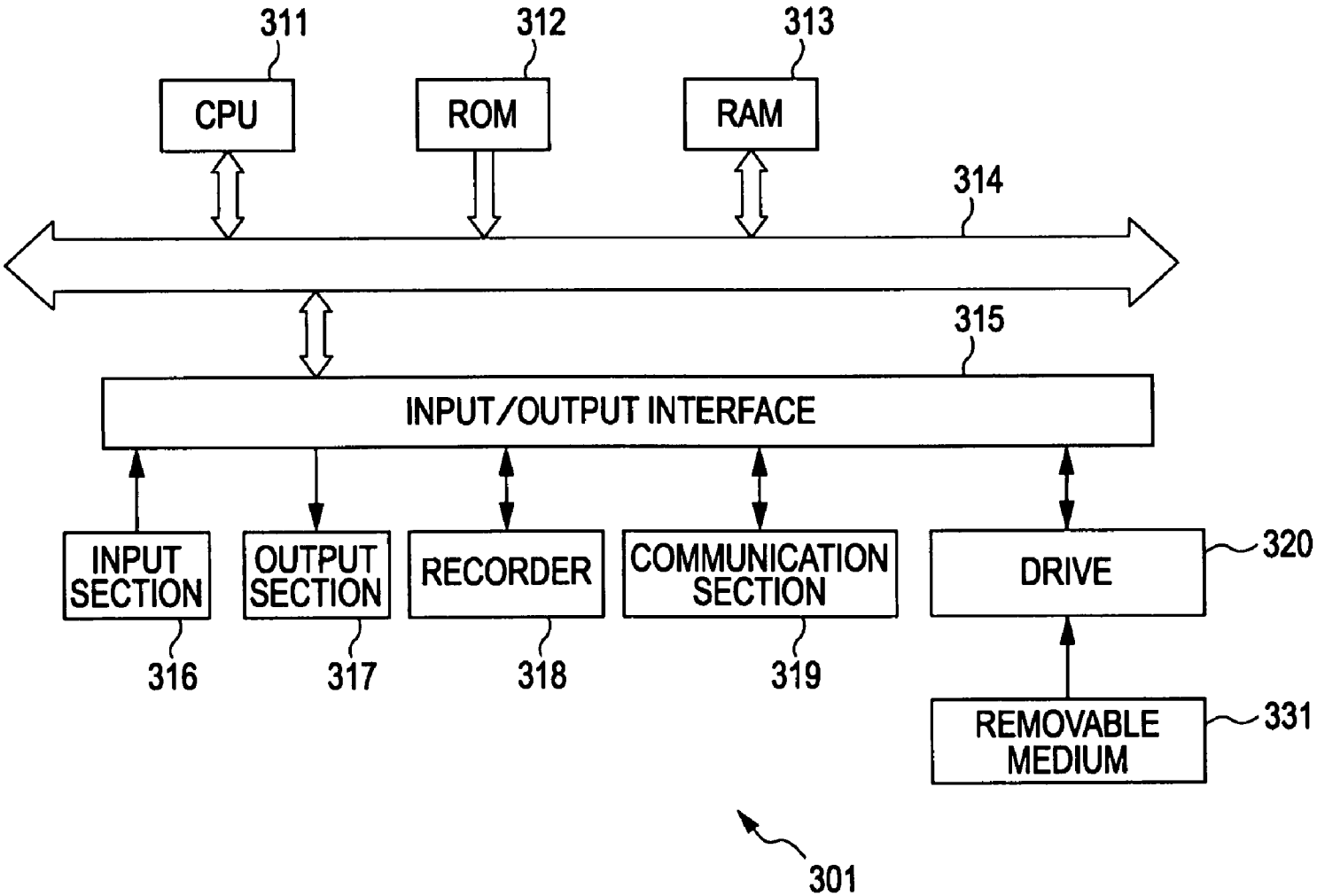
FIG. 24 is a block diagram showing an example of the configuration of a personal computer.

FIG. 24 is a block diagram showing an example of the configuration of a personal computer 301 for performing a series of processes in accordance with a program. A CPU (Central Processing Unit) 311 of the personal computer 301 performs various processes in accordance with a program recorded in a ROM (Read Only Memory) 312 or recorded in a recorder 318. In a RAM (Random Access Memory) 313, programs to be executed by the CPU 311, data, and the like are stored as appropriate. The CPU 311, the ROM 312, and the RAM 313 are interconnected with one another via a bus 314. An input/output interface 315 is connected to the CPU 311 via the bus 314.

An input section 316 including a keyboard, a mouse, a microphone and the like, and an output section 317 including a display, a speaker and the like are connected to the input/output interface 315. The CPU 311 performs various processes in accordance with instructions input from the input section 316. Then, the CPU 311 outputs processing results to the output section 317.

The recorder 318 connected to the input/output interface 315 is formed of, for example, a hard disk, and records programs to be executed by the CPU 311 and various kinds of data. A communication section 319 communicates with external devices via a network, such as the Internet and a local area network.

Programs may be obtained via the communication section 319 and may be recorded in the recorder 318.

A drive 320 connected to the input/output interface 315 drives a removable medium 331, such as a magnetic disk, an optical disc, a magneto-optical disc, or a semiconductor memory when it is loaded into the drive 320, and obtains the programs, data, and the like recorded thereon. The obtained programs and data are transferred to the recorder 318 and recorded as necessary.

The above-described series of processes can be performed by hardware and also by software. When the series of processes is to be performed by software, programs forming the software are installed from a program recording medium into a computer incorporated in specialized hardware or into, for example, a general-purpose personal computer capable of performing various kinds of functions by installing various programs.

As shown in FIG. 24, the program recording medium for storing programs that are installed into a computer and that are placed in a computer-readable state is formed of a magnetic disk (including a flexible disk), an optical disc (including a CD-ROM (Compact Disc-Read only Memory) and a DVD (Digital Versatile Disc)), a magneto-optical disc, a removable medium 331 that is a packaged medium formed of a semiconductor memory or the like, the ROM 312 in which programs are temporarily or permanently stored, a hard disk constituting the recorder 318, and the like. The storage of programs on the program recording medium is performed by using a wired or wireless communication medium, such as a local area network, the Internet, or a digital satellite broadcast, via the communication section 319, which is an interface such as a router or a modem, as necessary.

It should be understood by those skilled in the art that various modifications, combinations, sub-combinations and alterations may occur depending on design requirements and other factors insofar as they are within the scope of the appended claims or the equivalents thereof.

What is claimed is:

1. An audio output apparatus for converting an input audio signal into audio and outputting the audio, the audio output apparatus comprising:

a first oscillation enhancing panel that outputs the audio as a result of being oscillated;

a second oscillation enhancing panel that outputs the audio as a result of being oscillated;

a first transducer that allows the first oscillation enhancing panel to oscillate on the basis of an audio signal, the first transducer being attached in the first oscillation enhancing panel;

a second transducer that allows the first oscillation enhancing panel to oscillate on the basis of an audio signal, the second transducer being attached in the first oscillation enhancing panel, wherein the first transducer and the second transducer are disposed side by side in a horizontal direction in the first oscillation enhancing panel;

a third transducer that allows the second oscillation enhancing panel to oscillate on the basis of an audio signal;

a fourth transducer that allows the second oscillation enhancing panel to oscillate on the basis of an audio signal, wherein the third transducer and the fourth transducer are disposed side by side in a horizontal direction in the second oscillation enhancing panel, and a horizontal distance between the third transducer and the fourth transducer is shorter than a horizontal distance between the first transducer and the second transducer.

2. The audio output apparatus according to claim 1, further comprising a filtering unit that allows components of a predetermined frequency bandwidth among components of the audio signal input to the first transducer or the third transducer to pass.

3. The audio output apparatus according to claim 1, further comprising a gain adjustment unit that adjusts the gain of the audio signal input to the first transducer or the third transducer.

4. The audio output apparatus according to claim 1, wherein a size of the first oscillation enhancing panel is a same size of the second oscillation enhancing panel, and a position of the third transducer, in which a center of the second oscillation enhancing panel is used as a reference, differs from a position of the first transducer, in which a center of the first oscillation enhancing panel is used as a reference.

5. The audio output apparatus according to claim 1, wherein at least one of thickness, size, material, and fixation method of the first oscillation enhancing panel differs from thickness, size, material, and fixation method of the second oscillation enhancing panel.

6. An audio output method for converting an input audio signal into audio and outputting the audio, the audio output method comprising:

attaching a first transducer for allowing a first oscillation enhancing panel to oscillate on the basis of an audio signal in the first oscillation enhancing panel that outputs the audio as a result of being oscillated;

attaching a second transducer for allowing the first oscillation enhancing panel to oscillate on the basis of an audio signal, wherein the first transducer and the second transducer are disposed side by side in a horizontal direction in the first oscillation enhancing panel;

attaching a third transducer for allowing a second oscillation enhancing panel to oscillate on the basis of an audio signal in the second oscillation enhancing panel for outputting the audio as a result of being oscillated;

attaching a fourth transducer for allowing the second oscillation enhancing panel to oscillate on the basis of an audio signal, wherein the third transducer and the fourth transducer are disposed side by side in a horizontal direction in the second oscillation enhancing panel, and a horizontal distance between the third transducer and the fourth transducer is shorter than a horizontal distance between the first transducer and the second transducer; and inputting an audio signal to the first transducer and the second transducer and outputting audio by allowing the first oscillation enhancing panel and the second oscillation enhancing panel to oscillate so that an oscillation excitation position of the second oscillation enhancing panel becomes different from a position corresponding to an oscillation excitation position of the first oscillation enhancing panel.

7. An audio output apparatus for converting an input audio signal into audio and outputting the audio, the audio output apparatus comprising:

a first oscillation enhancing panel that outputs the audio as a result of being oscillated;

a second oscillation enhancing panel that outputs the audio as a result of being oscillated;

a first transducer that allows the first oscillation enhancing panel to oscillate on the basis of an audio signal, the first transducer being attached in the first oscillation enhancing panel; and a second transducer that allows the second oscillation enhancing panel to oscillate on the basis of an audio signal, the second transducer being attached at a position on the second oscillation enhancing panel, the position of the second transducer in the second oscillation enhancing panel corresponding to the position of the first transducer in the first oscillation enhancing panel, wherein at least one of the thickness, size, material, and fixation method of the first oscillation enhancing panel differs from the thickness, size, material, and fixation method of the second oscillation enhancing panel.

8. The audio output apparatus according to claim 1, wherein the first oscillation enhancing panel and the second oscillation enhancing panel are removably arranged within the audio output apparatus.

9. The audio output apparatus according to claim 1, further comprising:

a third oscillation enhancing panel that outputs the audio as a result of being oscillated;

a fifth transducer that allows the third oscillation enhancing panel to oscillate on the basis of an audio signal; and a sixth transducer that allows the third oscillation enhancing panel to oscillate on the basis of an audio signal, wherein the fifth transducer and the sixth transducer are disposed side by side in a vertical direction in the third oscillation enhancing panel.

10. The audio output apparatus according to claim 9, wherein the first oscillation enhancing panel, the second oscillation enhancing panel, and the third oscillation enhancing panel each have a different frequency characteristic.

11. The audio output apparatus according to claim 9, wherein the first oscillation enhancing panel, the second oscillation enhancing panel, and the third oscillation enhancing panel each are of a different size.

12. The audio output apparatus according to claim 9, wherein the first oscillation enhancing panel, the second oscillation enhancing panel, and the third oscillation enhancing panel are arranged in a vertical direction.

13. The audio output apparatus according to claim 12, wherein the first oscillation enhancing panel is on top of the second oscillation enhancing panel, which is on top of the third oscillation enhancing panel.

* * * * *